US010988887B2

(12) United States Patent
Sasaki et al.

(10) Patent No.: US 10,988,887 B2
(45) Date of Patent: Apr. 27, 2021

(54) WASHING MACHINE

(71) Applicant: Toshiba Lifestyle Products & Services Corporation, Kawasaki (JP)

(72) Inventors: Hironori Sasaki, Kawasaki (JP); Tomonori Uchiyama, Kawasaki (JP)

(73) Assignee: Toshiba Lifestyle Products & Services Corporation, Kawasaki (JP)

( * ) Notice: Subject to any disclaimer, the term of this patent is extended or adjusted under 35 U.S.C. 154(b) by 130 days.

(21) Appl. No.: 16/015,881

(22) Filed: Jun. 22, 2018

(65) Prior Publication Data

US 2018/0298541 A1 Oct. 18, 2018

Related U.S. Application Data

(63) Continuation of application No. PCT/JP2016/085764, filed on Dec. 1, 2016.

(30) Foreign Application Priority Data

Dec. 25, 2015 (JP) ..... JP2015-253938
Oct. 17, 2016 (JP) ..... JP2016-203532

(51) Int. Cl.
*D06F 39/02* (2006.01)
*D06F 33/02* (2006.01)
(Continued)

(52) U.S. Cl.
CPC ..... *D06F 39/02* (2013.01); *D06F 33/00* (2013.01); *D06F 39/08* (2013.01); *D06F 39/088* (2013.01); *D06F 35/002* (2013.01)

(58) Field of Classification Search
CPC ..... D06F 39/08; D06F 39/02; D06F 33/00; D06F 39/088; D06F 35/002
See application file for complete search history.

(56) References Cited

U.S. PATENT DOCUMENTS

2010/0181208 A1 7/2010 Denison et al.

FOREIGN PATENT DOCUMENTS

CN 201212110 Y 3/2009
CN 101795757 A 8/2010
(Continued)

OTHER PUBLICATIONS

Machine Translation of JP 2016007308 to Uchiyama, Jan. 2016. (Year: 2016).*
(Continued)

*Primary Examiner* — Benjamin L Osterhout
(74) *Attorney, Agent, or Firm* — Oblon, McClelland, Maier & Neustadt, L.L.P.

(57) ABSTRACT

A washing machine includes a water tub storing water, a rotary tub arranged in the water tub, a dissolving area in which a detergent is fed and dissolved, an FB feed-water pathway which includes a fine-bubble generation apparatus allowing generation of fine bubble water and along which water fed from a feed-water source is passed through the fine-bubble generation apparatus to be fed to the dissolving area as fine bubble water, an FB feed-water valve opening and closing the FB feed-water pathway, and a control apparatus controlling opening and closing of the FB feed-water valve. The detergent and the fine bubble water are controllably brought into contact with each other to dissolve the detergent, in a washing course in which the washing machine is operated and during a period when the detergent is dissolved in feed-water.

16 Claims, 15 Drawing Sheets

(51) Int. Cl.

| | |
|---|---|
| ***D06F 39/08*** | (2006.01) |
| ***D06F 33/00*** | (2020.01) |
| *D06F 35/00* | (2006.01) |

(56) References Cited

FOREIGN PATENT DOCUMENTS

| | | | | |
|---|---|---|---|---|
| CN | 103122568 | A | | 5/2013 |
| CN | 103747858 | A | | 4/2014 |
| CN | 105544147 | A | | 5/2016 |
| JP | 8-206390 | | | 8/1996 |
| JP | 8-206390 | A | | 8/1996 |
| JP | 2000-197795 | | | 7/2000 |
| JP | 2011-88979 | A | | 5/2011 |
| JP | 2012-515634 | | | 7/2012 |
| JP | 2012-515634 | A | | 7/2012 |
| JP | 2014-57 | A | | 1/2014 |
| JP | 2014-129097 | | | 7/2014 |
| JP | 2015-2876 | A | | 1/2015 |
| JP | 5712292 | | | 5/2015 |
| JP | 2016-7308 | | | 1/2016 |
| JP | 2016007308 | A | * | 1/2016 |
| KR | 2000-0045029 | A | | 7/2000 |
| WO | WO2003057969 | A | | 7/2003 |
| WO | WO 2013/012069 | A1 | | 1/2013 |

OTHER PUBLICATIONS

International Search Report dated Jan. 17, 2017 in PCT/JP2016/085764, filed on Dec. 1, 2016.
Office Action dated Sep. 3, 2019 in corresponding Japanese Patent Application No. 2018-093770, 3 pages.
Extended European Search Report dated Jul. 31, 2019 in European Patent Application No. 16878299.3, 8 pages.
Office Action dated Nov. 18, 2018 in Korean Patent Application No. 10-2018-7019732.
Combined Office Action and Search Report dated May 30, 2019 in Chinese Patent Application No. 201680075649.7 (with English translation of category of cited documents), 8 pages.
Office Action dated May 11, 2020 in corresponding European Patent Application No. 16 878 299.3; 5 pages.
Office Action dated Aug. 13, 2020 in connection with the corresponding Egyptian patent application 2018/061007.
Office Action dated Aug. 31, 2020,in connection with the corresponding Vietnamese patent Application No. 1-2018-03207, filed on Dec. 1, 2016.

* cited by examiner

| | WASH | DRAIN/SPIN | RINSE | DRAIN | FINAL RINSE | DRAIN/SPIN |
|---|---|---|---|---|---|---|
| MAIN FEED-WATER VALVE | ↑ | | ↑ | | ↑ | |
| FB FEED-WATER VALVE | ↑ | | | | | |
| SOFTENER FEED-WATER VALVE | | | | | ↑ | |

FIG. 5

WASHING MACHINE

TECHNICAL FIELD

Embodiments of the present invention relate to a washing machine.

BACKGROUND ART

Fine bubbles containing fine air bubbles having a sphere equivalent diameter of approximately several hundred μm to several tens of nm (ultrafine bubbles or microbubbles) have various properties such as an excellent surfactant activity and a high washing effect and are expected to be applied to a wide range of industries.

For example, Patent Literature 2 discloses a technique for providing a fine-bubble generation apparatus (UFB unit) in a feed-water pathway in a washing machine and using the fine-bubble generation apparatus to generate a large number of fine bubbles to allow fine bubble water containing the fine bubbles to be used for washing. Using the fine bubble water in this manner allows washing performance to be improved based on interaction between a detergent and the fine bubbles, for example, surface charge on the fine bubbles allows a surfactant in the detergent to be adsorbed to the fine bubbles to make the detergent more likely to react with dirt.

CITATION LIST

Patent Literature

Patent Literature 1: International Publication No. WO 2013/012069

Patent Literature 2: Japanese Patent Laid Open No. 2016-7308

SUMMARY OF INVENTION

Technical Problem

Furthermore, the above-described fine-bubble generation apparatus utilizes what is called a Venturi effect in fluid dynamics to increase the flow velocity of water to rapidly reduce pressure, thus causing air dissolved in water to be extracted in the form of a large volume of fine air bubbles. Thus, if water is passed through the fine-bubble generation apparatus and then fed to a washing tub through a detergent housing unit in a water injection case, the flow rate of water inevitably decreases. As a result, possible defects are predicted, for example, feeding water to the washing tub takes a longer time than needed or an amount of detergent remains undissolved in the detergent housing unit.

Thus, a washing machine is provided that is provided with a fine-bubble generation apparatus to allow effective use of fine bubbles to improve washing performance based on interaction between a detergent and the fine bubbles.

Solution to Problem

A washing machine according to an embodiment includes a water tub storing water, a rotary tub arranged in the water tub, a dissolving area in which a detergent is fed and dissolved, an FB feed-water pathway which includes a fine-bubble generation apparatus allowing generation of fine bubble water and along which water fed from a feed-water source is passed through the fine-bubble generation apparatus to be fed to the dissolving area as fine bubble water, an FB feed-water valve opening and closing the FB feed-water pathway; and a control apparatus controlling opening and closing of the FB feed-water valve. The detergent and the fine bubble water are controllably brought into contact with each other to dissolve the detergent, in a washing course in which the washing machine is operated and during a period when the detergent is dissolved in feed-water.

Furthermore, the washing machine according to the embodiment includes a washing tub in which clothes are housed, a water injection case which has a detergent housing unit and through which water is fed to the washing tub, an FB feed-water pathway which includes a fine-bubble generation apparatus and along which water fed from a feed-water source is passed through the fine-bubble generation apparatus to be fed to the water injection case as fine bubble water, an FB feed-water valve opening and closing the FB feed-water pathway, a main feed-water pathway configured to have a higher flow rate than the FB feed-water pathway and which does not pass through the fine-bubble generation apparatus, the main feed-water pathway allowing water fed from the feed-water source to be fed to the water injection case, a main feed-water valve opening and closing the main feed-water pathway, and a control apparatus controlling the main feed-water valve and the FB feed-water valve. The detergent housing unit is a dissolving area for a detergent, and the control apparatus controllably feeds water by alternately opening the main feed-water valve and the FB feed-water valve during an initial phase of water feeding.

The fine bubbles in the embodiment are a concept including, for example, microbubbles having a diameter of approximately 1 μm to several hundred μm and ultrafine bubbles having a diameter of approximately 50 nm to 1 μm.

BRIEF DESCRIPTION OF DRAWINGS

FIG. 5 is a timing chart for opening and closing of a feed-water valve according to the embodiments.

DESCRIPTION OF EMBODIMENTS

Figure 1:
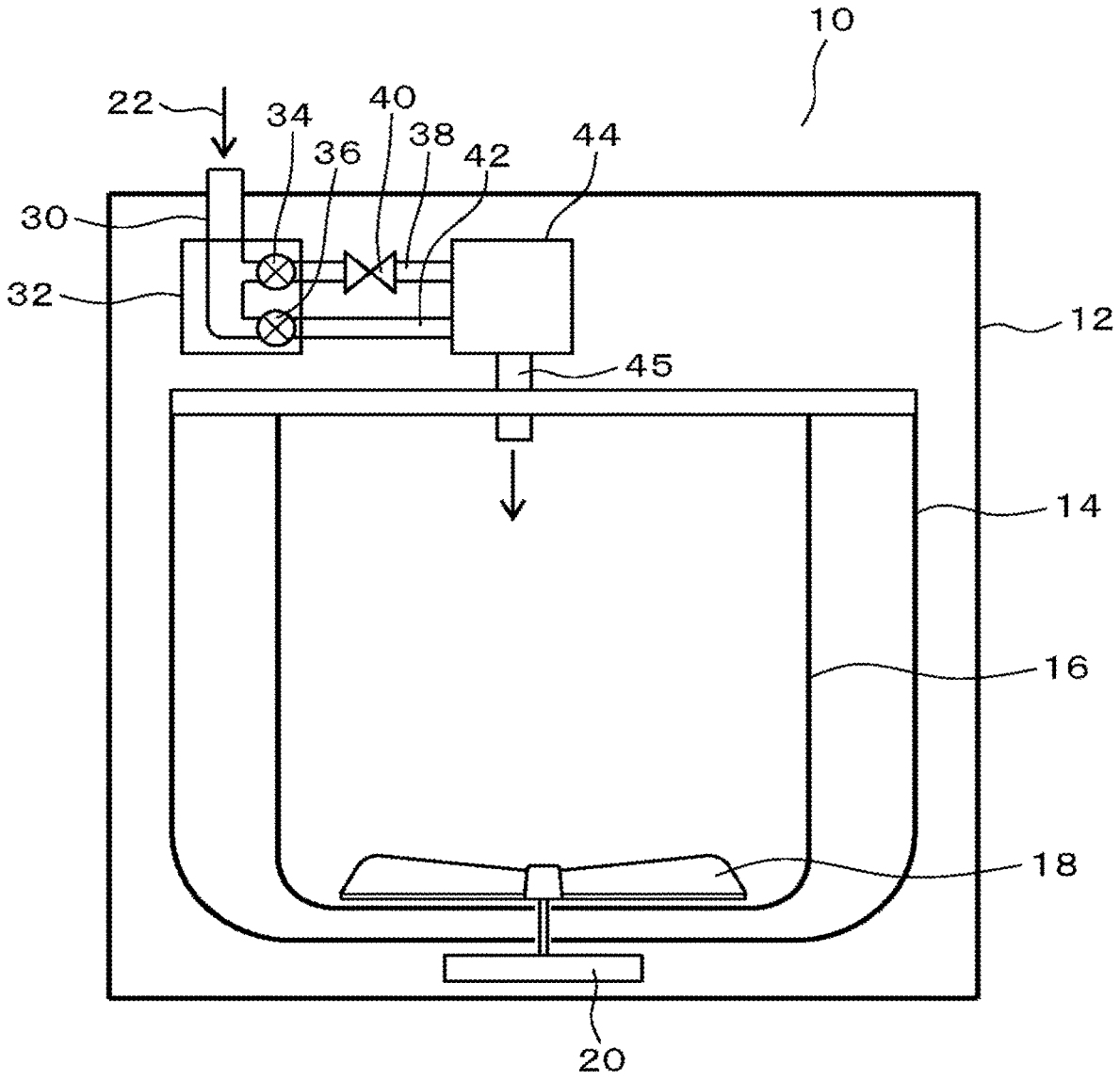
FIG. 1 is a vertical cross-sectional view illustrating a structure of a washing machine according to a first embodiment

Washing machines according to a plurality of embodiments will be described with reference to the drawings. Substantially the same components in the embodiments are denoted by the same reference numerals and will not be described.

First Embodiment

A first embodiment will be described below. A washing machine 10 illustrated in FIG. 1 includes an outer box 12, a water tub 14, a rotary tub 16, a pulsator 18, and a washing machine motor 20. An installation surface side of the washing machine 10, in other words, a vertically lower side thereof, is defined as a lower side of the washing machine 10. A side of the washing machine 10 opposite to the installation surface, in other words, a vertically upper side, is defined as an upper side of the washing machine 10.

The washing machine 10 is what is called a vertical-axis washing machine in which the rotary tub 16 has a rotation axis facing in a vertical direction. The outer box 12 constitutes a shell of the washing machine 10. The outer box 12 is, for example, formed of a steel plate or the like and shaped like a generally rectangular box, and has an opening in a top portion. The water tub 14 is housed inside the outer box 12. The rotary tub 16 is housed inside the water tub 14. The water tub 14 is shaped like a bottomed cylinder having an opening on an upper side and a water tub bottom portion on a lower side. Similarly, the rotary tub 16 is shaped like a bottomed cylinder having an opening on an upper side and a rotary tub bottom portion on a lower side.

The water tub 14 has a drain provided at the water tub bottom portion and not illustrated in the drawings. The washing machine 10 also includes a drain valve 52 illustrated in FIG. 2 and a drain hose connected to the drain valve 52 and not illustrated in the drawings. The drain valve 52 is, for example, electronically controlled solenoid valve and is controllably driven by a control apparatus 46. Opening the drain valve 52 causes water in the water tub 14 to be discharged to the outside of the washing machine 10 through the drain via the drain valve 52.

The rotary tub 16 has a plurality of holes not illustrated in the drawings, and makes the inside of the rotary tub 16 in communication with the outside of the rotary tub 16. The holes are formed all over a peripheral wall mostly constituting a cylindrical tubular portion of the rotary tub 16. Water supplied to the water tub 14 flows into and out of the rotary tub 16 through the holes.

The pulsator 18 is provided in the rotary tub 16 near the rotary tub bottom portion. The pulsator 18 is rotatable relative to the rotary tub 16. The washing machine motor 20 is provided outside the water tub 14 at the water tub bottom portion. The washing machine motor 20 is, for example, an outer-rotor DC brushless motor. The washing machine motor 20 is connected to the rotary tub 16 and the pulsator 18 by a clutch not illustrated in the drawings. The clutch not illustrated in the drawings is capable of selectively switching between a form in which only the pulsator 18 rotates and a form in which the pulsator 18 and the rotary tub 16 integrally rotate. The pulsator 18 rotates relative to the rotary tub 16 to stir laundry housed inside the rotary tub 16.

The washing machine 10 includes, at a top portion thereof, a feed-water pipe 30, a feed-water valve unit 32, and a detergent case 44. For example, a faucet for tap water or bathwater intake means is connected to the feed-water pipe 30 to supply raw water 22 for washing. The feed-water valve unit 32 has the feed-water pipe 30 diverging to a fine bubble (hereinafter sometimes referred to as FB) feed-water valve 34 and to a main feed-water valve 36. The FB feed-water valve 34 is connected to a fine-bubble generator 40, which is further connected to an FB pipe 38. The fine-bubble generator 40 functions a a fine-bubble generation apparatus. The FB pipe 38 is connected to the detergent case 44 via a main pipe 42. In this configuration, the raw water 22 fed into the feed-water pipe 30 is diverged into a route passing through the FB feed-water valve 34, the fine-bubble generator 40, and the FB pipe 38 and a bypass route passing through the main feed-water valve 36 and the main pipe 42. The routes are connected to the detergent case 44, and the raw water 22 is fed, via the detergent case 44, into the water tub 14 through a feed-water inlet 45.

The fine-bubble generator 40 is an apparatus that generates fine bubbles in a liquid passing through a channel provided inside the fine-bubble generator 40, in this case, water. The fine-bubble generator 40 may use, for example, a cavitation method to generate fine bubbles by rapidly reducing the pressure of the liquid flowing through the channel inside the fine-bubble generator 40. Another method, for example, a pressurized dissolution method, a high-speed swirl liquid flow method, a micropore method, or a gas-liquid two-phase flow swirling method may be used. Alternatively, a fine-bubble generation apparatus described in Japanese Patent Application No. 2014-129097 previously filed by the applicant may be utilized. The fine-bubble generator 40 is capable of mainly generating air bubbles including ultrafine bubbles having a sphere equivalent bubble diameter of approximately 50 nm to 1 μm. The fine bubbles in the present embodiment include ultrafine bubbles having a sphere equivalent bubble diameter of 50 nm to 1 μm.

The fine bubbles are generally classified as follows, based on the sphere equivalent bubble diameter thereof. For example, air bubbles having a diameter of 1 mm or more are referred to as millibubbles, fine bubbles having a diameter of approximately 1 μm to several hundred μm are referred to as microbubbles, and fine bubbles having a diameter of approximately less than 1 μm are referred as ultrafine bubbles or nanobubbles. Furthermore, fine bubbles including microbubbles and ultrafine bubbles and having a diameter of several hundred μm or less are collectively referred to as fine bubbles. Ultrafine bubbles, having a bubble diameter of less than 1 μm, are smaller than the wavelength of light and are thus invisible. This makes the liquid containing the ultrafine bubbles transparent. These fine bubbles are characterized by, for example, a large total interface area, a slow floating speed, and a high internal pressure, and are thus known to have an excellent capability of washing objects in a liquid.

For example, ultrafine bubbles have the following nature. The ultrafine bubbles reside in water over a long time while making Brownian motion. Energy involved in collapse resulting from a self-pressurizing effect decomposes substances to generate free radicals. Surfaces of air bubbles are negatively charged, and thus, the ultrafine bubbles repel one another and are not bonded together. The ultrafine bubbles also act to attract positively charged organisms. Due to such nature, the ultrafine bubbles have a high washing effect.

Furthermore, microbubbles are negatively charged and are thus likely to adsorb positively charged foreign matter floating in the liquid. Thus, the foreign matter broken as a result of collapse of the microbubbles is adsorbed to the microbubbles and floats slowly toward the surface of the liquid. Then, the foreign matter having gathered on the liquid surface is removed to purify the liquid. Consequently, high washing capability is delivered.

In the first embodiment, the fine-bubble generator 40 mainly generates ultrafine bubbles that are air bubbles having a diameter of approximately 50 nm to 1 μm as described above. Water containing fine bubbles is hereinafter referred to as fine bubble water.

Figure 2:
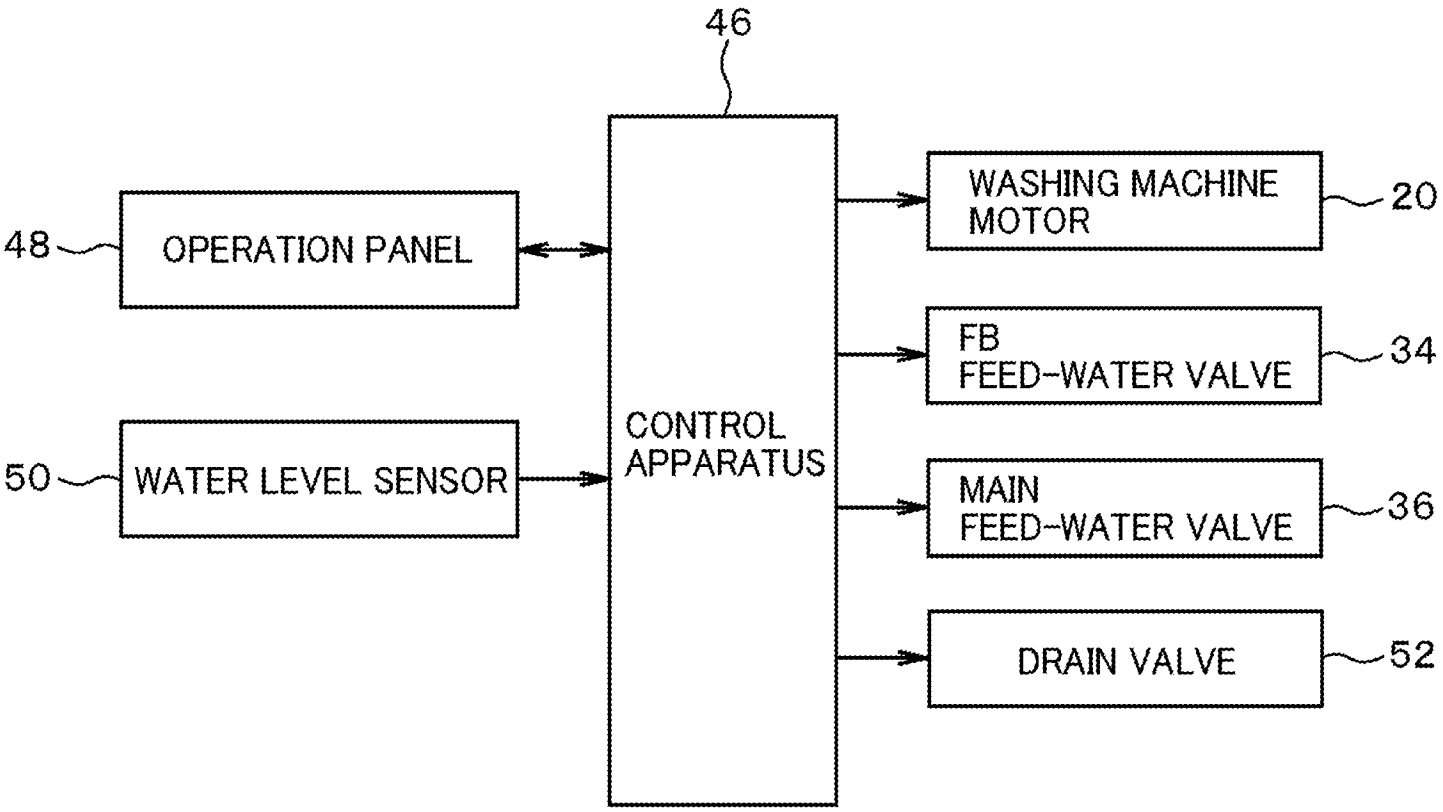
FIG. 2 is a block diagram illustrating a general configuration of the washing machine according to the embodiment.

FIG. 2 is a block diagram of that portion of an electric configuration of a washing machine which relates to the spirits of the present invention. In FIG. 2, the washing machine 10 includes an operation panel 48 for, e.g., operations for the contents of a washing course, a water level sensor 50 sensing a water level in the water tub 14, the washing machine motor 20, which rotates the pulsator 18, the FB feed-water valve 34, and the main feed-water valve 36, and the drain valve 52. The control apparatus 46 is composed mainly of a microcomputer. The control apparatus 46 has a function to control, for example, a washing operation for washing, rinsing, and spinning of laundry. Signals from the operation panel 48 and the water level sensor 50 are input to the control apparatus 46.

The control apparatus 46 has a function to control rotation of the washing machine motor 20 and opening and closing of the FB feed-water valve 34, the main feed-water valve 36, and the drain valve 52 based on the above-described input signals and a pre-installed control program.

Operations of the first embodiment will be described with reference to FIG. 5. FIG. 5 is a timing chart illustrating opening and closing timings for the FB feed-water valve 34, the main feed-water valve 36, and a softener feed-water valve 37 during a wash step, a drain and spin step, a rinse step, a drain step, a final rinse step, and a drain and spin step. The softener feed-water valve 37 will be described below in a third embodiment.

In the wash step, first, the control apparatus 46 controllably opens the FB feed-water valve 34. As illustrated in FIG. 1, the FB feed-water valve 34 is connected to the fine-bubble generator 40. Therefore, the raw water 22 fed through the FB feed-water valve 34 is turned into fine bubble water when passing through the fine-bubble generator 40. The fine bubble water passes through the FB pipe 38 and is first fed to the detergent case 44. A detergent is preliminarily fed into the detergent case 44. The detergent is dissolved by bringing the detergent and the fine bubble water into contact with each other and mixing and stirring the detergent and the fine bubble water. In this case, the detergent case 44 is a dissolving area for the detergent. The control may be such that, before the fine bubble water is fed to the detergent case 44, a small volume of, for example, tap water or the like as the raw water 22 may be fed into the detergent case 44 to bring the raw water 22 into pre-contact with the detergent to dampen the detergent or that, after the detergent is swept away and fed onto the laundry in the rotary tub 16 by the force of tap water, the fine bubble water may be passed through the detergent case 44.

At this time, the fine bubble water has negative charge on the surface thereof and is thus likely to adsorb a surfactant likely to he positively charged, that is, a detergent. Thus, compared to typical tap water, the fine bubble water can disperse the detergent in water in a short time, and thus, the fine bubble water is fed onto the detergent during the period when the detergent is dissolved into the feed-water, allowing the detergent to be successfully dissolved. The fine bubble water and the detergent are stirred into a washing solution with the detergent dispersed and dissolved therein. The washing solution is run with the flow of the fine bubble water fed into the detergent case 44, and is fed into the water tub 14 through the feed-water inlet 45. In this case, the detergent case 44 may be provided with a detergent dissolving chamber where the detergent and the fine bubble water are brought into contact with each other and stirred.

Then, as illustrated in FIG. 5, the control apparatus 46 controllably keeps the FB feed-water valve 34 open until before the wash step is ended, and when the detergent in the detergent case 44 is completely dissolved, closes the FB feed-water valve 34 and opens the main feed-water valve 36 to fill the inside of the water tub 14 with washing water. As the typical raw water 22, for example, tap water is fed to the main feed-water valve 36. The main pipe 42 is connected to the main feed-water valve 36, and the fine-bubble generator 40 is not connected to the main pipe 42. Therefore, the raw water 22 is directly fed to the detergent case 44 while bypassing the fine-bubble generator 40. If an amount of detergent remains undissolved, the detergent is swept away to clean the inside of the detergent case 44, while water is simultaneously fed into the water tub 14 through the feed-water inlet 45.

If the fine-bubble generator 40 has a mechanism generating fine bubbles, for example, based on the cavitation method, a water channel in the fine-bubble generator 40 has a reduced diameter to reduce the pressure and thus the flow rate of water. Thus, if the fine bubble water generated by the fine-bubble generator 40 is continuously fed until the end of the process, the total water feeding time is very long. Thus, the main pipe 42 is further provided, which is a feed-water pathway bypassing and not passing through the fine-bubble generator 40. Consequently, the total water feeding time can be reduced by first opening the FB feed-water valve 34 for the feed-water pathway passing through the fine-bubble generator 40, and when the detergent fed into the detergent case 44 is exhausted, feeding water utilizing the main pipe 42, which is a bypass feed-water pathway not passing through the fine-bubble generator 40. Instead of being connected to the detergent case 44, the main pipe 42, which is a bypass feed-water pathway not passing through the fine-bubble generator 40, may have a feed-water inlet arranged above the water tub 14 to feed water directly into the water tub 14.

The first embodiment produces the following effects

During the period when the detergent is dissolved into feed-water at the beginning of the wash step, fine bubble water is fed into the detergent case 44 into which the detergent has been fed, and in the present embodiment, before feeding of typical tap water, the fine bubble water is controllably brought into contact with the detergent. This enables the detergent to be dissolved while being efficiently dispersed. This provides a washing machine 10 producing an improved washing effect.

Furthermore, after the detergent is dissolved into the fine bubble water, the raw water 22 such as typical tap water, which does not flow through the fine-bubble generator 40, is controllably fed to the water tub 14. Thus, compared to a case where all of the washing water is fine bubble water, the present embodiment enables a reduction in the time needed to feed water to the water tub 14 without degrading the washing effect.

Fine bubble water need not necessarily be fed at the beginning of the wash step. Even if the fine bubble water and the raw water 22 are fed in tandem, substantially similar effects are expected if the feeding takes place during the initial phase f water feeding, that is, during the period when the detergent is dissolved into the feed-water.

Second Embodiment

A second embodiment will be described below. Components of the second embodiment common to the first embodiment are hereinafter denoted by the same reference numerals and will not be described below.

Figure 3:
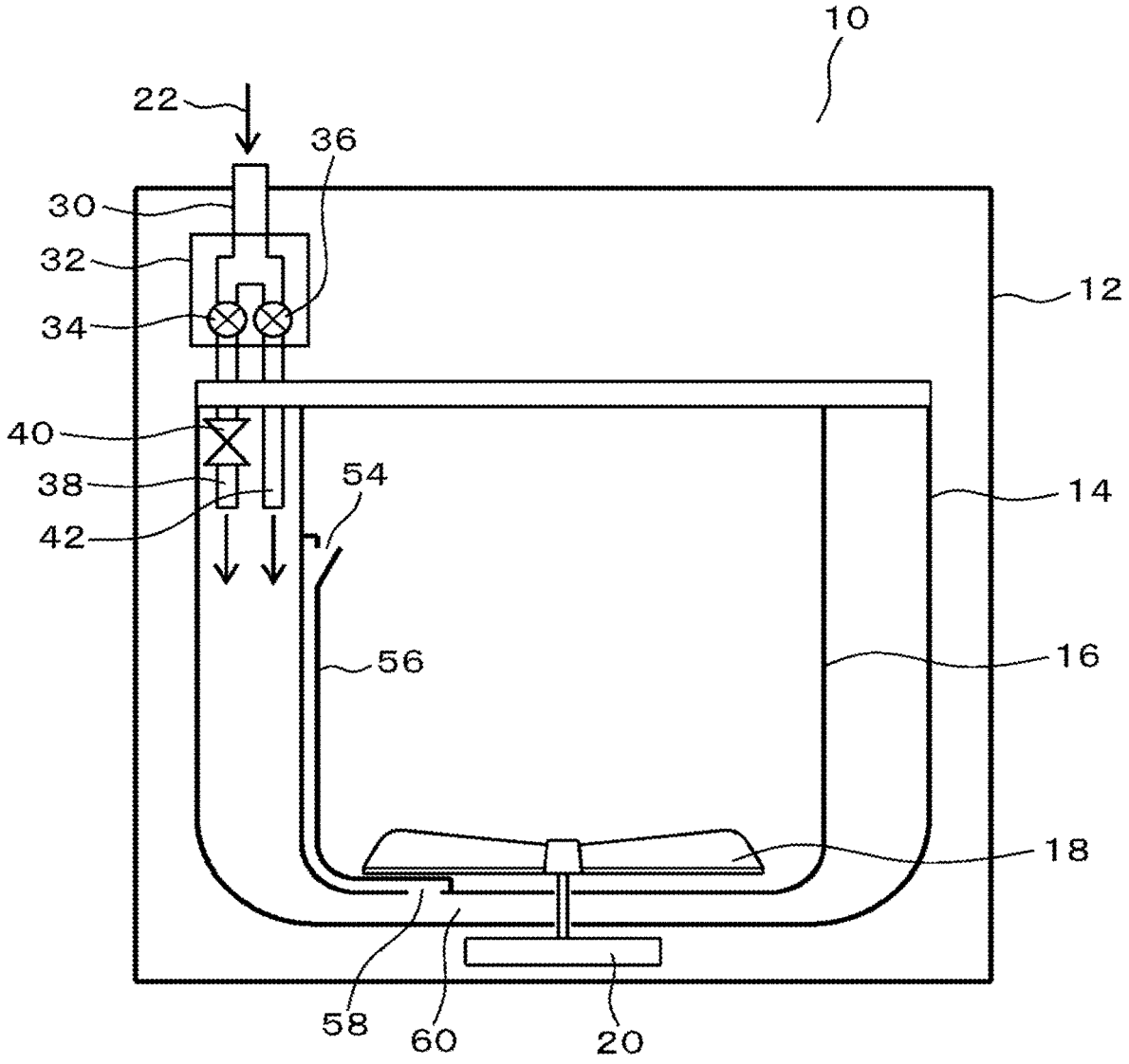
FIG. 3 is a vertical cross-sectional view illustrating a structure of a washing machine according to a second embodiment.

As illustrated in FIG. 3, the washing machine 10 according to the second embodiment includes the feed-water valve unit 32 and the fine-bubble generator 40. Fine bubble water resulting from passage through the FB feed-water valve 34 and the fine-bubble generator 40 is fed into an area between the water tub 14 and the rotary tub 16 through the FB pipe 38 and is first stored in a detergent dissolving area 60 at a bottom portion of the water tub 14. The raw water 22 having passed through the main feed-water valve 36 and the main pipe 42 without passing through the fine-bubble generator 40 is also fed into the area between the water tub 14 and the rotary tub 16 and then stored in the water tub 14. The washing machine 10 has a detergent inlet 54 on a side portion of the rotary tub 16. A detergent fed through the detergent inlet 54 passes through a detergent passageway 56 to an area below the pulsator 18 at the bottom portion of the rotary tub 16. A portion of the detergent falls onto the bottom portion of the water tub 14 through a detergent drop outlet 58.

Now, operations of the second embodiment will be described with reference to FIG. 5. First, the detergent has been fed through the detergent inlet 54 and is present near the detergent dissolving area 60 at the bottom portion of the water tub 14. In the wash step, the control apparatus 46 controllably opens the FB feed-water valve 34. As illustrated in FIG. 3, the FB feed-water valve 34 is equipped with the fine-bubble generator 40. Therefore, the raw water 22 fed through the FB feed-water valve 34 is turned into fine bubble water when passing through the fine-bubble generator 40. The fine bubble water passes through the FB pipe 38 and is fed into the area between the water tub 14 and the rotary tub 16 and stored in the bottom portion of the rotary tub 16. The control apparatus 46 recognizes that the fine bubble water has been stored to the degree that the pulsator 18 is immersed in the fine bubble water, and then controllably drives the pulsator 18. For sensing of a water level, the water level in the water tub 14 is sensed by the water level sensor 50, and a water level signal is transmitted to the control apparatus 46. The pulsator 18 is driven to stir the fine bubble water in the detergent dissolving area 60 at the bottom portion of the water tub 14. Consequently, the fine bubble water and the detergent first contact each other and are stirred into a washing solution with the detergent efficiently dispersed in the fine bubble water.

The control apparatus 46 determines that the detergent and the fine bubble water have been stirred sufficiently to dissolve the detergent, and then controllably closes the FB feed-water valve 34 and opens the main feed-water valve 36 to fill the inside of the water tub 14 with wash water.

The second embodiment produces effects similar to those of the first embodiment. Furthermore, since the washing machine has the detergent drop outlet 58 in communication with the detergent inlet 54, the detergent passageway 56, and the area below the pulsator 18, an undissolved, thick detergent is fed into the detergent dissolving area 60 without coming into direct contact with the laundry. Consequently, the detergent and the fine bubble water can be brought into contact with each other and stirred during the initial phase of water feeding, that is, during the period when the detergent is dissolved into the feed-water. Therefore, the detergent can be successfully dissolved.

Third Embodiment

A third embodiment will be described below. In addition to the components of the washing machine 10 according to the first embodiment or the second embodiment, the washing machine 10 according to the third embodiment includes a softener feed-water valve 37, a softener pipe 43, and a softener case 62. The third embodiment will be described below in detail.

Figure 4:
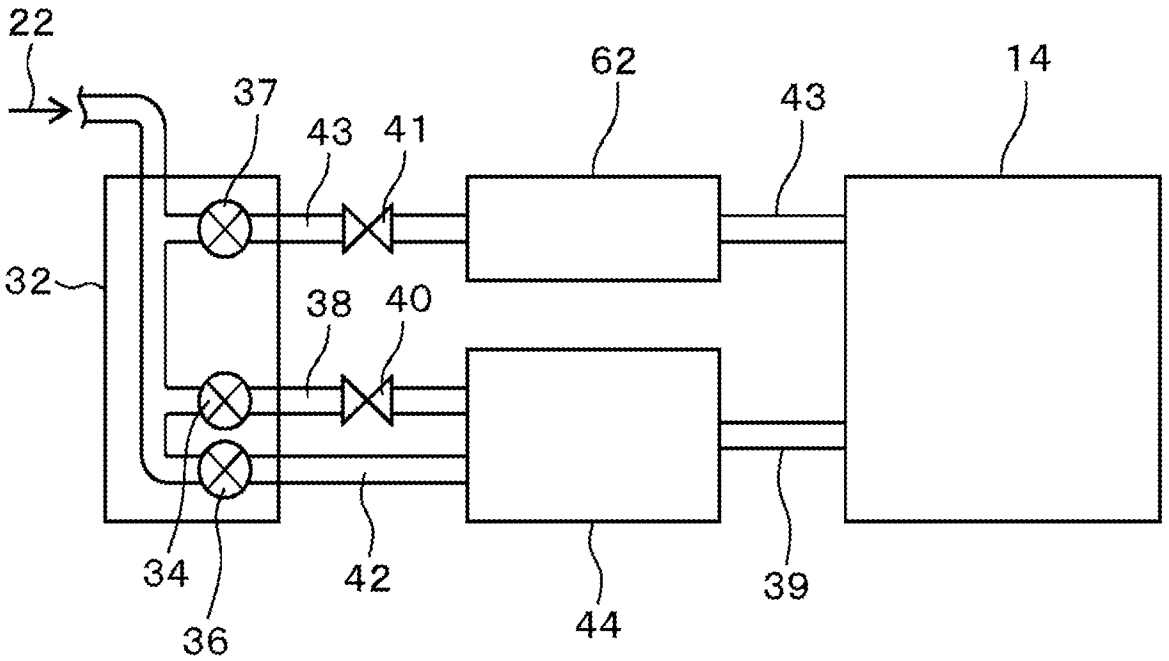
FIG. 4 is a schematic diagram illustrating a structure of a washing machine according to a third embodiment.

As illustrated in FIG. 4, the washing machine 10 includes the feed-water valve unit 32. The feed-water valve unit 32 is a multi-spool, in this case, three-spool feed-water valve including the FB feed-water valve 34, the main feed-water valve 36, and the softener feed-water valve 37. The softener feed-water valve 37 is connected to the softener case 62 via the softener pipe 43. A fine-bubble generator 41 is provided between the softener feed-water valve 37 and the softener case 62. A softener has been fed into the softener case 62 as a surfactant. The raw water 22 is turned into fine bubble water when passing through the fine-bubble generator 41, and the fine bubble water is fed to the softener case 62. In the softener case 62, the softener and the fine bubble water are brought into contact with each other and stirred to dissolve the softener into the fine bubble water. In this case, the softener case 62 is a softener dissolving area.

In this case, the fine bubble water has negative charge on the surface thereof, and is thus likely to adsorb a surfactant likely to be positively charged, that is, a softener. Thus, compared to typical tap water, the fine bubble water allows the softener to be dispersed therein in a short time, enabling the softener to be sufficiently dissolved. The softener is dissolved into the fine bubble water, resulting in softener water, which is fed to the water tub 14. In this case, the softener case 62 may be provided with a dissolving chamber, that is, a dissolving area, where the softener and the fine bubble water are brought into contact with each other and stirred to dissolve the softener into the fine bubble water.

The FB pipe 38, connected to the detergent case 44, has the fine-bubble generator 40, with water feeding controlled by the FB feed-water valve 34. The main pipe 42, which is a feed-water pathway connected to the detergent case 44, does not have the fine-bubble generator 40, and water feeding is controlled by the main feed-water valve 36. The main pipe 42 is what is called a bypass route not passing through the fine-bubble generator 40. The detergent case 44 is capable of feeding water to the water tub 14 via a feed pipe 39.

The outer box 12, the rotary tub 16, and other components are omitted from FIG. 4, and only the water tub 14 is representatively illustrated in FIG. 4. A specific structure of the washing machine in FIG. 4 is similar to the configuration of the outer box 12, the water tub 14, the rotary tub 16, the pulsator 18, and the washing machine motor 20 in FIG. 1 or FIG. 3. For example, if the present embodiment is applied to the washing machine 10 according to Embodiment 1, softener water fed from the softener case 62 is fed from above to the water tub 14 and the rotary tub 16. Furthermore, if the present embodiment is applied to the washing machine 10 according to Embodiment 2, the softener water fed from the softener case 62 is fed to the area between the water tub 14 and the rotary tub 16 and stored in the bottom portion of the water tub 14.

Operations of the third embodiment will be described. As illustrated in FIG. 5, in the final rinse step, the control apparatus 46 opens the softener feed-water valve 37 to feed the raw water 22 to the fine-bubble generator 41 via the softener pipe 43. The raw water 22 is turned into fine bubble water when passing through the fine-bubble generator 41, with the fine bubble water fed to the softener case 62. A softener is preliminarily fed into the softener case 62. Therefore, first, the fine bubble water and the softener are brought into contact with each other in the softener case 62 and stirred into a softener liquid with the softener dissolved in the fine bubble water. The resultant softener liquid passes through the softener pipe 43 and is fed into the water tub 14.

Then, when the softener in the softener case 62 is completely dissolved, the control apparatus 46 closes the softener feed-water valve 37 and opens the main feed-water valve 36. The raw water 22 having passed through the main feed-water valve 36 passes through the detergent case 44 and is fed to the water tub 14 via the feed pipe 39. Consequently, the water tub 14 is filled with the raw water 22 and the softener water with the softener dissolved into the fine bubble water.

The washing machine 10 according to the third embodiment produces the following effects.

During the initial phase of the final rinse step, that is, during the period when the softener is dissolved into the feed-water, the fine bubble water is controllably fed to the softener case 62 in which the softener is preliminarily fed. This enables the softener to be dissolved into the fine bubble water while being efficiently dispersed. Consequently, the softener more easily permeates clothes to allow washed laundry to be more softly finished. This provides a washing machine 10 exerting an improved softening effect during the final rinse.

Furthermore, after the softener is dissolved into the fine bubble water, the raw water 22 such as typical tap water is controllably fed to the water tub 14. Compared to a case where all of the rinse water is fine bubble water, the present embodiment enables a reduction in the total time needed to feed water to the water tub 14, while improving the softening effect.

In the first to third embodiments, what is called a vertical-axis washing machine in which the rotary tub has a rotation axis facing in the vertical direction has been illustrated and described as the washing machine 10. However, the present invention is not limited to this. For example, the washing machine 10 may be what is called a horizontal-axis drum washing machine in which the rotary tub has a rotation axis facing in a horizontal direction or inclined backward in a downward direction.

Fourth Embodiment

Figure 6:
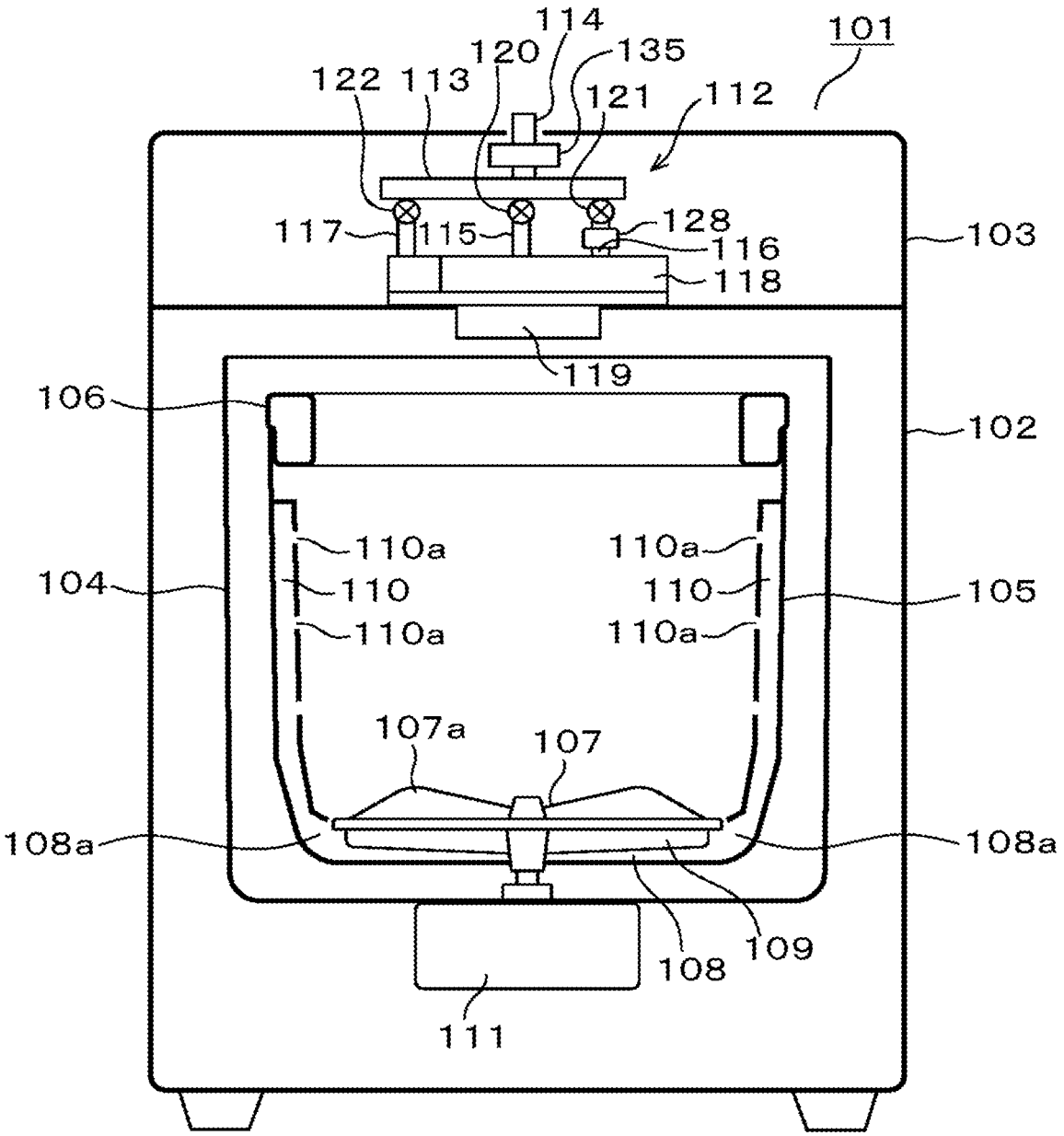
FIG. 6 is a vertical cross-sectional view schematically illustrating a configuration of a washing machine according to a fourth embodiment.

A fourth embodiment will be described with reference to FIGS. 6 to 10. FIGS. 6 to 9 illustrate a configuration common to the washing machines 10 according to a fourth to a ninth embodiments described below. FIG. 6 schematically illustrates a general configuration of a washing machine 101 corresponding to the present embodiment. The washing machine 101 includes a top cover 103 made of a synthetic resin and arranged over an outer box 102, for example, shaped generally like a rectangular box using a steel plate. A water tub 104 enabling washing water to be stored therein is provided in the outer box 102 and elastically suspended and supported by an elastic suspension mechanism with a well-known configuration (not illustrated in the drawings). Although not illustrated in the drawings, the water tub 104 has a drain formed at a bottom portion thereof and to which a drainage channel with a drain valve 132 (illustrated only in FIG. 9) is connected. In the outer box 102, a water level sensor 133 (illustrated only in FIG. 9) detecting the water level in the water tub 104 is installed via an air tube connected to an air trap provided at the bottom portion of the water tub 104.

In the water tub 104, a vertical-axis washing tub (rotary tub) 105 also used as a spin tub is rotatably provided. The washing tub 105 is shaped like a bottomed cylinder and has a large number of spin holes formed in a peripheral wall portion thereof and not illustrated in the drawings. A rotary balancer 106 of, for example, a liquid seal type is mounted at an upper end of the washing tub 105. A pulsator 107 is disposed at an inner bottom portion of the washing tub 105. In the washing tub 105, clothes not illustrated in the drawings are housed, and a washing operation including steps for washing, rinsing, and spinning of the clothes are performed.

In the present embodiment, a circular recessed area where the pulsator 107 is arranged is provided at an inner bottom portion of the washing tub 105 to form a pump chamber 108 between the washing tub 105 and the pulsator 107. In this case, the pulsator 107 is shaped like a disc having a protruding portion 107*a* on a front surface (upper surface) thereof for generation of rotary water flows, and has a plurality of holes (not illustrated in the drawings) formed in such a manner as to penetrate a disc surface in the vertical direction. The pulsator 107 also has a plurality of pump blades 109 integrally provided on a back surface thereof. The pump blades 109 are shaped like thin plates extending in a radial direction from a central portion. Outflow ports 108*a* (only two of the outflow ports are illustrated) are provided at three positions located on an outer circumferential portion of the pump chamber 108 at intervals of 120 degrees in a circumferential direction.

In a side wall portion of the washing tub 105, water channels 110 (only two of the water channels are illustrated) for pumping of washing water from the pump chamber 108 are provided in such a manner as to extend upward from the respective outflow ports 108*a*. The water channels 110 have discharge ports 110*a* below the rotary balancer 106, arranged at the top portion in the washing tub 105. Thus, the pulsator 107 in the pump chamber 108, in other words, the pump blades 109, rotate to discharge the washing water (fine bubble water with a detergent dissolved therein described below or water for rinsing) in the washing tub 105 through the three outflow ports 108*a* of the pump chamber 108 toward an outer circumference of the washing tub 105. The washing water is further raised (pumped up) through the water channels 110 and discharged (sprinkled) into the washing tub 105 through the discharge ports 110*a*.

Furthermore, a drive mechanism 111 with a well-known configuration is disposed at an outer bottom portion of the water tub 104. Although not illustrated or described in detail, the drive mechanism 111 includes a washing machine motor 134 (see FIG. 9) including, for example, an outer-rotor DC three-phase brushless motor. The drive mechanism 111 also includes a clutch mechanism selectively transmitting a drive force of the washing machine motor 134 of the drive mechanism 111 to the pulsator 107 or the washing tub 105; the clutch mechanism is not illustrated in the drawings. The washing machine motor 134 and the clutch mechanism are controlled by a control apparatus 131 described below. During washing and water-saving rinsing, the washing tub 105 is fixed (stopped), and the drive force of the washing machine motor 134 is transmitted to the pulsator 107, which is directly driven at low speed for normal or reverse rotation. During spinning and rinsing, during spinning, or the like, the clutch mechanism transmits the drive force of the washing machine motor 134 to the washing tub 105 to rotationally drive the washing tub 105 (and the pulsator 107) at high speed in one direction.

Figure 7:
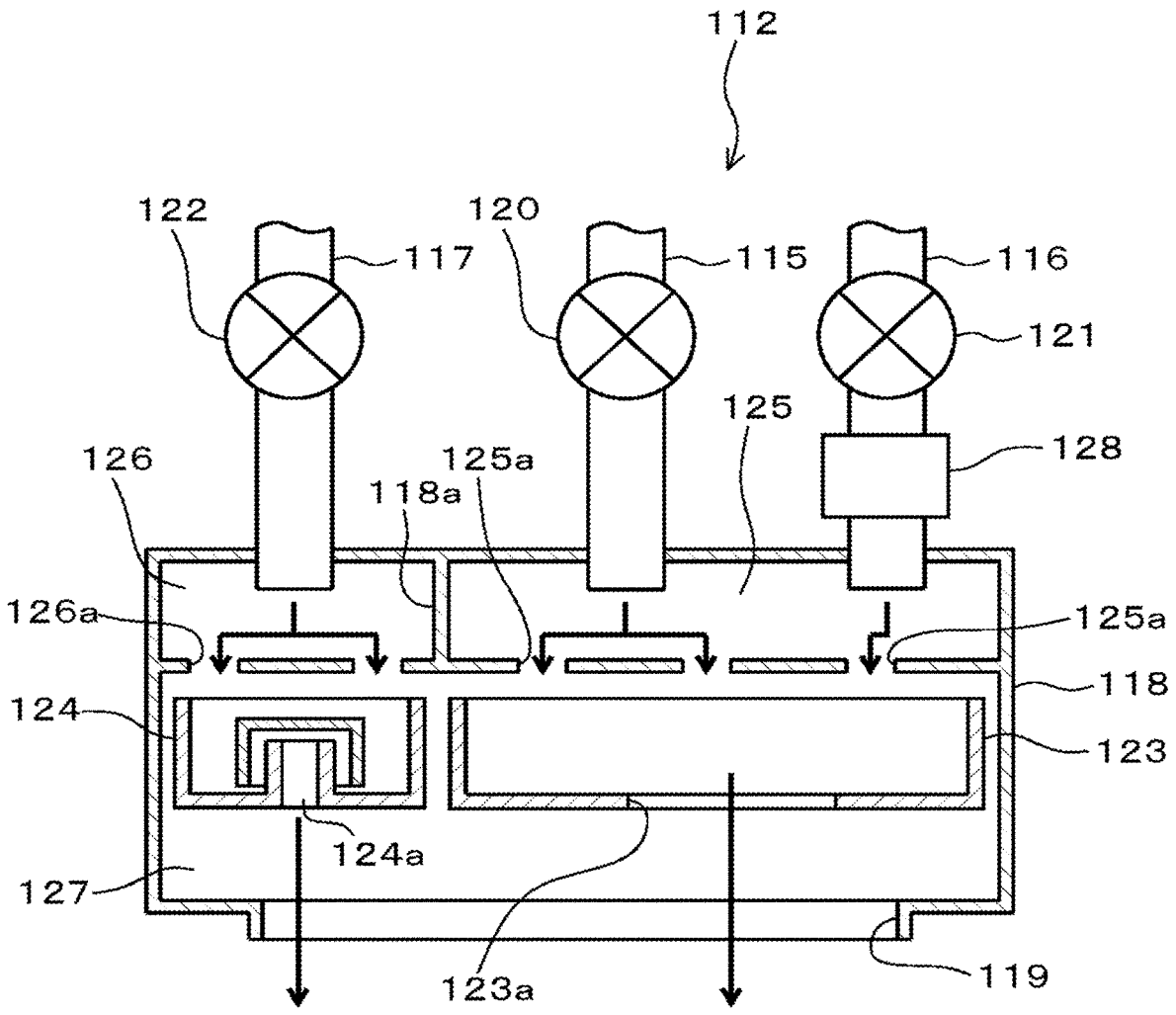
FIG. 7 is a vertical cross-sectional view schematically illustrating a configuration of a water injection case unit.
Figure 8:
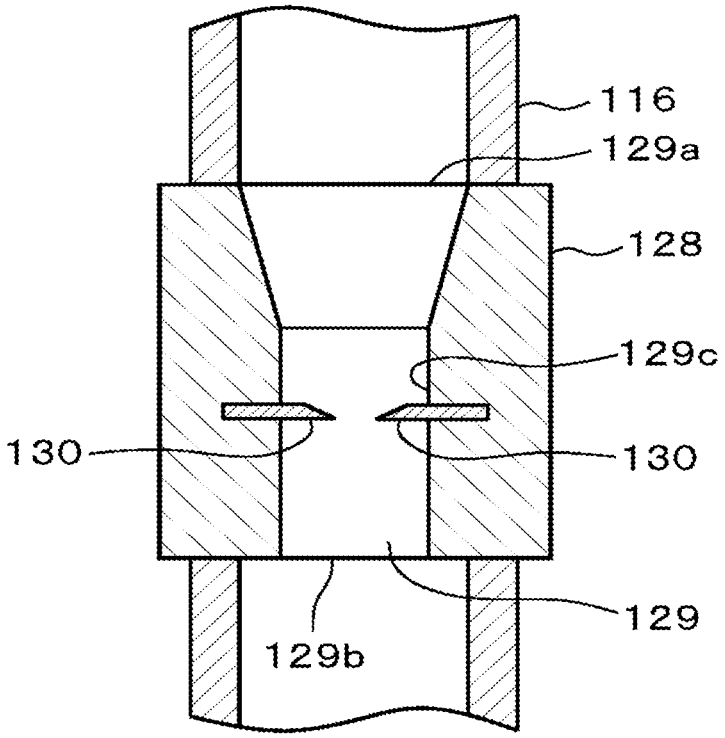
FIG. 8 is a cross-sectional view schematically illustrating a configuration of a UFB unit.

In the above-described top cover 103, a feed-water mechanism 112 feeding water into the water tub 104 (washing tub 105) is provided, as also partly illustrated in FIG. 7. In the present embodiment, the feed-water mechanism 112 includes a feed-water pathway 113, three feed-water valves 120 to 122, a water injection case 118, and a water injection port 119 that is an outlet portion of the water injection case 118. The feed-water pathway 113 has a hose connection port 114 connected at a proximal end thereof to a feed-water source such as tap water. The feed-water pathway 113 extends from the hose connection port 114 and diverges into three pathways: a main feed-water pathway 115, an FB feed-water pathway 116, and a softener feed-water pathway 117. A flowmeter 135 measuring the flow rate of water is provided on that side of the proximal end of the feed-water pathway 113 which is more proximal (more upstream) than a divergent portion.

As illustrated in FIG. 7, the water injection case 118 is shaped like a rectangular box and provided, in a middle stage portion thereof, with a detergent housing unit 123 positioned on the right side of the figure and in which a detergent is housed and a softener housing unit 124 positioned on the left side of the figure and in which a softener or the like is housed. The detergent housing unit 123 and the softener housing unit 124 are configured like drawers. In an upper portion of the water injection case 118, a first upper portion space 125 and a second upper portion space 126 are separated from each other by a partition plate 118*a* and positioned above the detergent housing unit 123 and the softener housing unit 124 respectively. Tip portions of the main feed-water pathway 115 and the FB feed-water pathway 116 are connected to an upper wall of the water injection case 118 in such a manner as to communicate with the first upper portion space 125. A tip portion of the softener feed-water pathway 117 is connected to an upper wall of the water injection case 118 in such a manner as to communicate with the second upper portion space 126.

Figure 9:
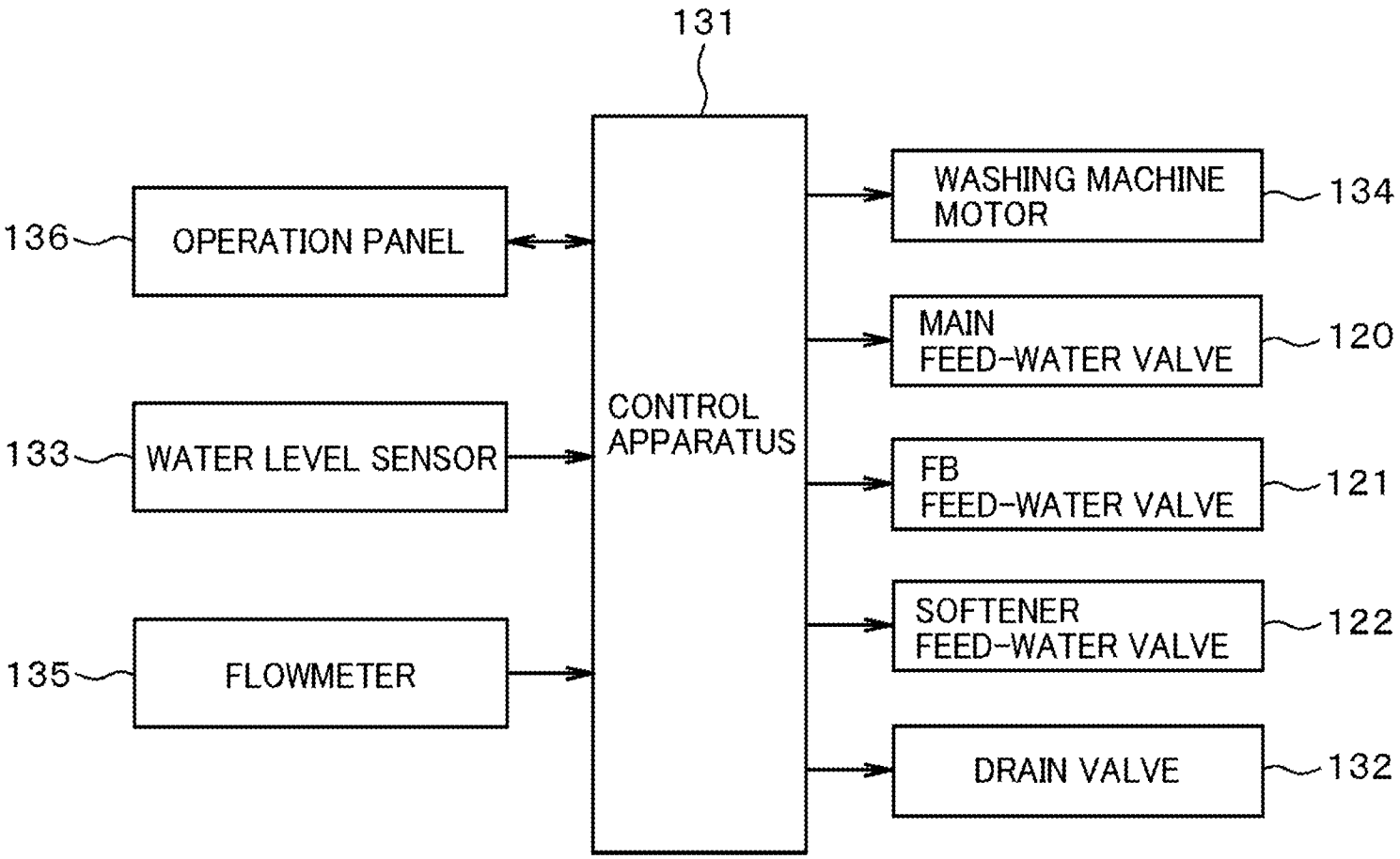
FIG. 9 is a block diagram illustrating an electric configuration.

Communication holes 125*a* in communication with the detergent housing unit 123 are formed at a bottom portion of the first upper portion space 125. Communication holes 126*a* in communication with the softener housing unit 124 are formed at a bottom portion of the second upper portion space 126. An outlet portion 123*a* of the detergent housing unit 123 and an outlet portion 124*a* of the softener housing unit 124 are in communication with a lower space 127 in the water injection case 118. The lower space 127 is connected to the water injection port 119. The main feed-water pathway 115 is provided with the main feed-water valve 120. The FB feed-water pathway 116 is provided with an FB feed-water valve 121 for fine bubbles and a UFB unit 128 described below. A softener pathway 17 is provided with a softener feed-water valve 122. The feed-water valves 120, 121, 122 are on-off valves that electromagnetically perform opening and closing operations, and are controlled by the control apparatus 131 as illustrated in FIG. 9.

Thus, opening the main feed-water valve 120 causes water from the feed-water source to flow through the main feed-water pathway 115 to the detergent housing unit 123 in the water injection case 118. If a detergent is housed in the detergent housing unit 123, the water is discharged through the water injection port 119 while dissolving the detergent, and is injected into the water tub 104 (washing tub 105). In this case, tap water containing no fine bubble is fed directly into the water tub 104 through the main feed-water pathway 115. At this time, the flow rate of water fed through the main feed-water pathway 115 is higher than (for example, approximately double) the flow rate of water fed through the FB feed-water pathway 116.

Furthermore, opening the FB feed-water valve 121 for fine bubbles causes water from the feed-water source to flow through the FB feed-water pathway 116 to the detergent housing unit 123 in the water injection case 118. If a detergent is housed in the detergent housing unit 123, the water is discharged through the water injection port 119 while dissolving the detergent, and is injected into the water tub 104. In this case, the detergent housing unit 123 serves as a detergent dissolving area. At this time, as described below, water flowing through the FB feed-water pathway 116 is turned into fine bubble water containing a large volume of fine bubbles when passing through the UFB unit 128, and washing water containing the fine bubble water with the detergent dissolved therein is fed into the water tub 104 (washing tub 105).

Moreover, opening the softener feed-water valve 122 for softeners causes water from the feed-water source to flow through the softener feed-water pathway 117 to the softener housing unit 124 in the water injection case 118. If a softener is housed in the softener housing unit 124, the water is discharged through the water injection port 119 while dissolving the softener, and is injected into the water tub 104 (washing tub 105). In this case, the softener housing unit 124 serves as a softener dissolving area. The softener is fed into the water tub 104 during the final water-saving rinse step. Although not illustrated in detail, the top cover 103 is provided with an entrance for clothes, a cover opening and closing the entrance, and an operation panel 136 (see FIG. 9).

In the present embodiment, the UFB unit 128, serving as a fine-bubble generation apparatus utilizing the principle of a Venturi tube, is provided in such a manner as to be integrated into the vicinity of an entrance of the FB feed-water pathway 116 located on a downstream side of the FB feed-water valve 121. The UFB unit 128 will be described with reference to FIG. 8. The UFB unit 128 is formed of, for example, a synthetic resin and shaped like a cylinder having an axial direction corresponding to an up-down direction in the figure. The UFB unit 128 is provided with a channel 129 extending in the up-down direction in the figure. The channel 129 is open at end surfaces of both upper and lower ends of the UFB unit 128. An opening on the upper end side in the figure is designated as an inflow port 129*a*, and an opening on the lower end side in the figure is designated as an outflow port 129*b*.

In a middle portion of the channel 129, a throttle portion 129*c* having the smallest channel cross-sectional area is formed. The channel 129 is tapered such that the channel sectional area gradually decreases from the inflow port 129*a* to the throttle portion 129*c* and is substantially uniform between the throttle portion 129*c* and the outflow port 129*b*. The UFB unit 128 is further provided with four protruding portions 130 (only two of the protruding portions 130 are illustrated) in such a manner as to further narrow the channel of the throttle portion 129*c*. The protruding portions 130 each have a conical tip portion and are provided at intervals of 90 degrees in such a manner as to protrude inward from an outer circumferential side of the throttle portion 129*c*.

Consequently, a cross section of the throttle portion 129*c* at a central portion thereof is shaped like a cross slit formed by the conical portions at the tips of the four opposite protruding portions 130. The protruding portions 130 may be provided on the UFB unit 128 by integral molding.

In the UFB unit 128 as described above, when the FB feed-water valve 121 is opened to cause water to flow through the inflow port 129*a* into the channel 129, the water passes through the protruding portions 130 at an increased flow velocity due to what is called a Venturi effect in fluid dynamics resulting from the reduced cross-sectional area between the inflow port 129*a* and the throttle portion 129*c*. Therefore, the pressure is rapidly reduced. This allows air dissolved in the water to be extracted in the form of a large volume of fine bubbles. The UFB unit 128 is capable of generating a large volume of fine bubbles mostly containing ultrafine bubbles having a diameter of approximately 50 nm to 1 μm and further containing even microbubbles having a diameter of approximately 1 μm to several hundred μm.

FIG. 9 schematically illustrates an electric configuration of the washing machine 101 around the control apparatus 131. The control apparatus 131 is composed mainly of a computer to control the washing machine 101 as a whole. The control apparatus 131 connects to the operation panel 136 and receives sensing signals from the water level sensor 133 and the flowmeter 135. In this case, the control apparatus 131 is capable of integrating sensing signals from the flowmeter 135 to calculate the volume of water fed.

The control apparatus 131 also controls the washing machine motor 134, the drain valve 132, the main feed-water valve 120, the FB feed-water valve 121, and the softener feed-water valve 122. In this configuration, the control apparatus 131 controls the mechanisms of the washing machine 101 to automatically perform a well-known washing operation including a wash step, a rinse step, and a spin step, in accordance with an operation course set by the user on the operation panel 136 and based on the input signals from the sensors and the pre-stored control program.

In this case, the control apparatus 131 feeds water by alternately opening the main feed-water valve 120 and the FD feed-water valve 121 during the initial phase of water feeding at the beginning of the wash step mainly with the software configuration of the control apparatus 131, as discussed in the following description of operations. During this water feeding, the softener feed-water valve 122 is closed. This results in alternate execution of a water feeding aspect in which a high flow rate of water is fed to the water injection case 116 through the main feed-water pathway 115 (this is referred to as main water feeding) and a water feeding aspect in which fine bubble water is fed to the water injection case 118 through the FB feed-water pathway 116 (this is referred to as FB water feeding); each water feeding aspect is executed a plurality of times.

Furthermore, in the present embodiment, the FB feed-water valve 121 is first opened (FB water feeding) when the water feeding is started. Moreover, in the present embodiment, the control apparatus 131 performs switching control (opening and closing control) of the main feed-water valve 120 and the FB feed-water valve 121 based on counting of an open time. During, for example, the rinse step following the wash step, the main feed-water valve 120 is opened (the FB feed-water valve 121 and the softener feed-water valve 122 are closed) to feed water up to a predetermined water level. During the final water-saving rinse step, the softener feed-water valve 122 is opened (the main feed-water valve 120 and the FB feed-water valve 121 are closed) to feed water up to a predetermined water level, thus allowing water with the softener dissolved therein to be fed into the water tub 104.

Now, operations and effects of the washing machine 101 configured as described above will be described with also reference to FIG. 10. Before starting the washing operation, the user placed, in the washing tub 105, clothes to be washed and also places a predetermined volume of detergent in the detergent housing unit 123 in the water injection case 118. The user then performs a start operation on the operation panel 136. Then, the control apparatus 131 automatically performs the washing operation including the wash step, the rinse step, and the spin step. At this time, when the washing operation is started, first, a well-known cloth amount sensing operation is performed, and based on the result of the sensing, the feed-water water level is automatically determined. The operation then proceeds to the wash step.

Figure 10:
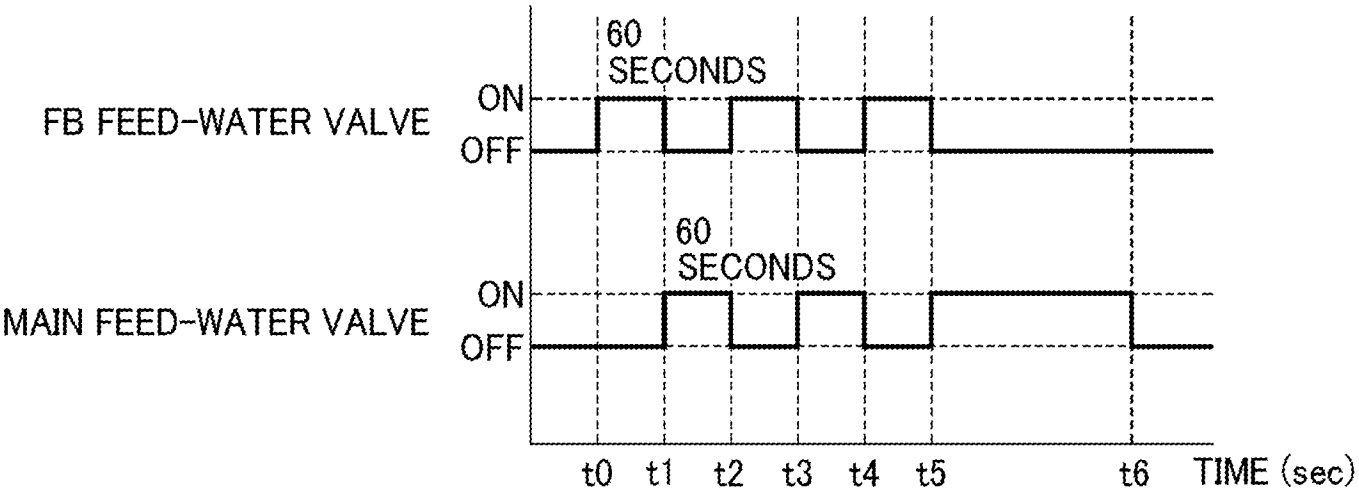
FIG. 10 is a time chart illustrating how each feed-water valve is controllably opened and closed.

FIG. 10 is a time chart illustrating how the control apparatus 131 controllably opens and closes the FB feed-water valve 121 and the main feed-water valve 120 for water feeding at the beginning of the wash step. As illustrated in FIG. 10, when the wash step is started (time t0), first, the FB feed-water valve 121 is opened (the main feed-water valve 120 and the softener feed-water valve 122 are closed) to perform FB water feeding. The opening of the FB feed-water valve 121 causes water from the feed-water source (tap water) to flow through the FB feed-water pathway 116 to the UFB unit 128 at a relatively high pressure corresponding to a tap water pressure. When the water passes through the UFB unit 128, a large volume of fine bubbles are generated to become fine bubble water, which is fed to the water injection case 118. The fine bubble water, containing the large volume of fine bubbles, flows while dissolving the detergent in the detergent housing unit 123. The fine bubble water is fed into the water tub 104 while dissolving the detergent.

The FB feed-water valve 121 is kept open (FB water feeding), e.g., for 60 seconds, and at time t1, the FB feed-water valve 121 is closed and the main feed-water valve 120 is opened. Thus, the FB water feeding is switched to the main water feeding to cause water having passed through the main feed-water pathway 115 to be fed directly to the water injection case 118. The water then flows while dissolving the detergent in the detergent housing unit 123, and the water with the detergent dissolved therein is fed into the water tub 104. In this case, the main feed-water pathway 115 has a relatively high flow rate, and thus, the detergent is caused to gush through the main feed-water pathway 115 and fed into the water tub 104 without remaining undissolved. Compared to the FB water feeding, the main water feeding allows approximately double the volume of water to be fed in the same amount of time. The main feed-water valve 120 is also kept open (main water feeding), e.g., for 60 seconds, and at time t2, the main water feeding is switched to the FB water feeding again.

As described above, the switching between the FB water feeding and the main water feeding is alternately performed, for example, every 60 seconds. When, for example, the third FB water feeding is ended (time t5), the FB water feeding is switched to the main water feeding again (third time). For example, the third main water feeding is continuously performed until the water level in the water tub 104 (washing tub 105) reaches the predetermined water level. When the predetermined water level in the water tub 104 is reached (time t6), the main feed-water valve 120 is closed, and a wash step is started in which the pulsator 107 is driven and rotated in the normal direction and in the reverse direction.

In this case, the wash step is executed with the washing water stored in the water tub 104 (washing tub 105), the washing water containing the fine bubble water with the detergent dissolved therein. When the wash step for the predetermined time is ended, the pulsator 107 is stopped, and the water tub 104 is drained. Subsequently, the rinse step and the spin step are executed.

The above-described fine bubbles have the property of making Brownian motion, that is, irregular motion in a liquid, for example, water and residing in the liquid over a long time because the speed of the motion is higher than the floating speed. The surfaces of the fine bubbles are negatively charged, and thus adsorb a mass of detergent content (surfactant) included in the wash water, while dispersing the detergent content. The surfaces serve to improve dispersibility of the detergent. The fine bubbles repel one another and are prevented from being bonded together. Furthermore, the fine bubbles thus having adsorbed the detergent content are capable of infiltrating easily into gaps (for example, 10 μm) among fibers of clothes to efficiently carry the detergent into the clothes to peel off dirt from the clothes. The fine bubbles refrain the dirt from adhering to the clothes again.

Such functions of the fine bubbles allow an excellent washing effect to be produced by executing the wash step using the washing water containing the fine bubble water containing a large volume of fine bubbles and the detergent dissolved therein. In this case, since the UFB unit 128 generates fine bubble water and then the detergent is dissolved into the fine bubble water, the detergent can be effectively dispersed in the washing water with a high concentration of fine bubbles. If, in contrast, fine bubbles are generated after the detergent is dissolved into the water, the washing water may be excessively bubbled, precluding sufficient generation of fine bubbles, resulting in a reduced concentration of fine bubbles.

When the wash step for the predetermined time is ended, the pulsator 107 is stopped and the water tub 104 is drained. Subsequently, the rinse step and the spin step are executed. During the rinse step, water can be fed into the water tub 104 through the main feed-water pathway 115 the softener feed-water pathway 117, which does not pass through the UFB unit 128. A relatively high flow rate of water is provided during this step to enable water feeding to be achieved in a short time.

Thus, according to the present embodiment, during the initial phase of water feeding, the main water feeding, in which a high flow rate of water is fed to the water injection case 118 through the main feed-water pathway 115, is alternated with the FB water feeding, in which fine bubble water is fed to the water injection case 118 though the FB feed-water pathway 116. This allows compatible achievement of effective dispersion of the detergent content in the washing water with a high concentration of fine bubbles and sweeping away of the detergent in the detergent housing unit 123 with no detergent remaining undissolved, using a high flow rate of water. Furthermore, the fine bubble water easily mixes with normal water. As a result, the configuration with the UFB unit 128 for generating fine bubbles is very effective for allowing the effective use of fine bubbles to improve washing performance based on the interaction between the detergent and the fine bubbles.

In particular, in the present embodiment, the control apparatus 131 is configured to perform the switching control of the main feed-water valve 120 and the FB feed-water valve 121 based on the counting of the open time. This allows reliable switching to the main water feeding while obtaining a needed volume of fine bubble water through FB water feeding for a needed time. This in turn allows water feeding to be achieved in a relatively short total time needed. Moreover, in the present embodiment, the FB feed-water valve 121 is first opened at the beginning of water feeding. Consequently, when the washing operation is started, first, the fine bubble water is brought into contact with the detergent and the washing water containing the fine bubble water with the detergent dissolved therein is fed to the clothes in the washing tub 105. This allows enhancement of an improving effect on the washing performance.

Fifth Embodiment

Figure 11:
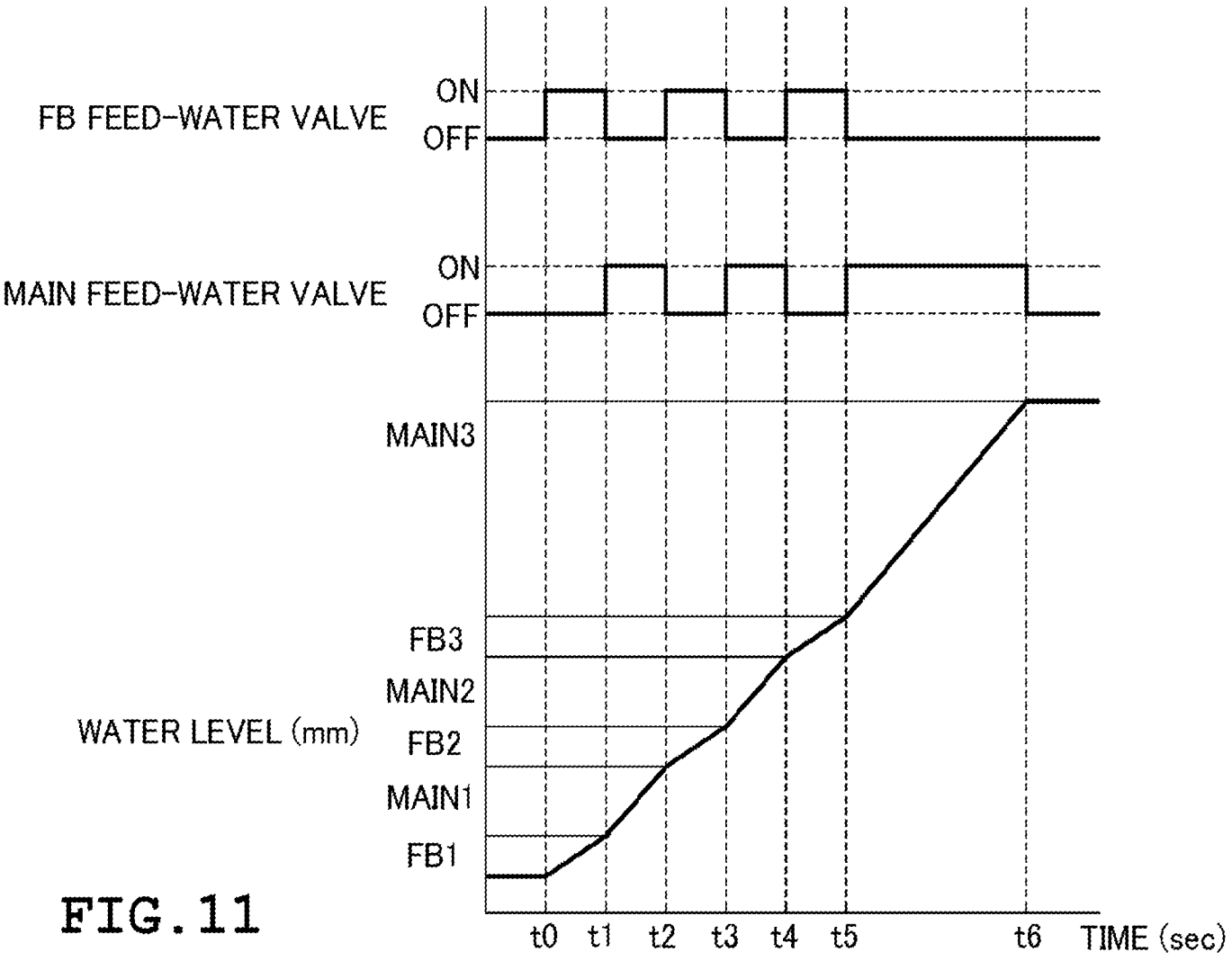
FIG. 11 is a time chart illustrating how each feed-water valve is controllably opened and closed according to a fifth embodiment.

FIG. 11 illustrates a fifth embodiment. The fifth embodiment is different from the fourth embodiment in the process, by the control apparatus 131, of opening and closing control of the FB feed-water valve 121 and the main feed-water valve 120 during the water feeding at the beginning of the wash step. That is, in the fifth embodiment, the control apparatus 131 performs the switching control of the main feed-water valve 120 and the FB feed-water valve based on, instead of the temporal control, detection of the water level in the washing tub 105 detected by a water level sensor 133.

Specifically, when the wash step is started (time t0), first, the FB feed-water valve 121 is opened to perform FB water feeding. The FB feed-water valve 121 is kept open (FB water feeding) until the water level reaches FB1 (for example, equivalent to five liters), and at that time (time t2), the FB feed-water valve 121 is closed and the main feed-water valve 120 is opened to switch from the FB water feeding to the main water feeding. The main water feeding is continuously performed until the water level reaches Main 1 (for example, equivalent to 15 liters), and at time t2, the main water feeding is switched to the FB water feeding again.

Moreover, when the water level reaches FB2 (for example, equivalent to 20 liters), the FB water feeding is switched to the main water feeding (time t3). When the water level reaches Main2 (for example, equivalent to 30 liters), the main water feeding is switched to the FB water feeding (time t4). When the water level reaches FB3 (for example, equivalent to 35 liters), the FB water feeding is switched to the third main water feeding (time t5). The third main water feeding is continuously performed until the water level reaches Main 3 with a predetermined water level (for example, equivalent to 65 liters). When the water feeding up to the predetermined water level in the water tub 104 is ended (time t6), the main feed-water valve 120 is closed and the wash step is started.

According to the fifth embodiment, as is the case with the fourth embodiment, the UFB unit 128 for generating fine bubbles is provided to allow the main water feeding and the FB water feeding to be alternated with each other during the initial phase of water feeding. This is effective for allowing the effective use of fine bubbles to improve the washing performance based on the interaction between the detergent and the fine bubbles. Furthermore, particularly in the present embodiment, switching between the main feed-water valve 120 and the FB feed-water valve 121 is performed based on detection of the water level in the washing tub 105. Consequently, general water feeding can be achieved by reliably switching from the FB water feeding to the main water feeding while obtaining a needed volume of fine bubble water by the FB water feeding, with no adverse effects of a low water pressure or the like.

Sixth Embodiment

Figure 12:
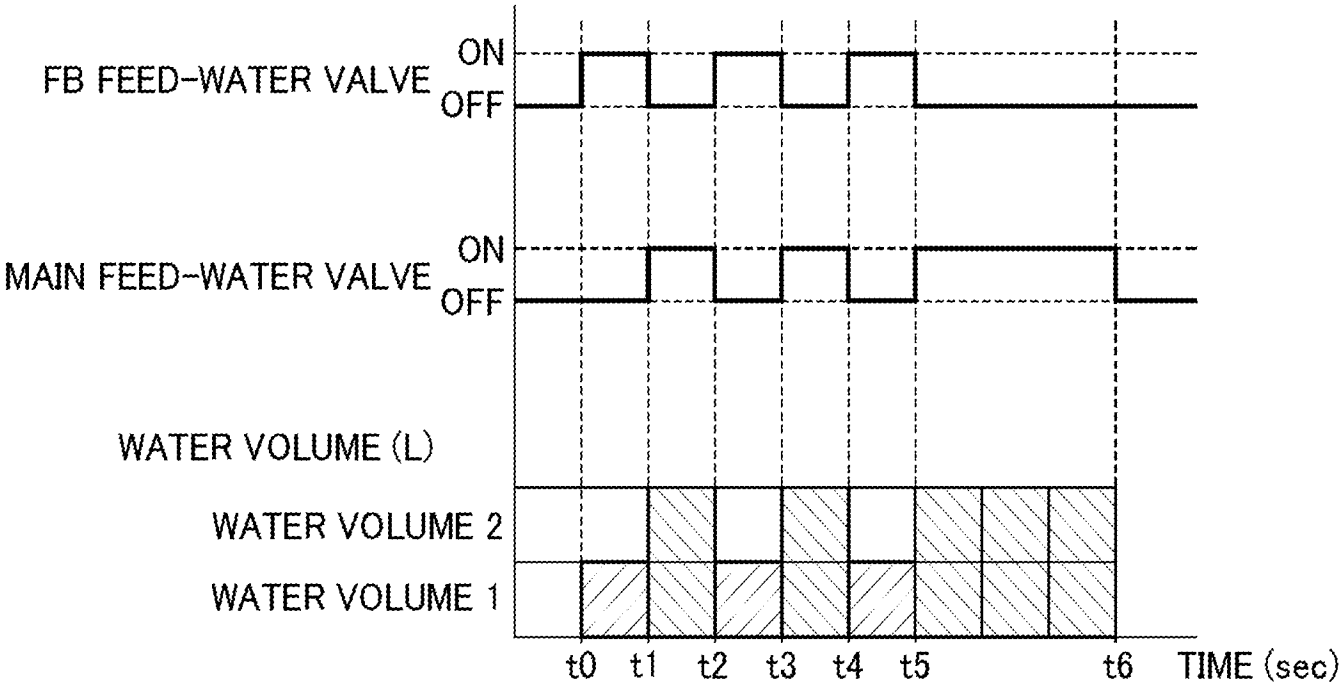
FIG. 12 is a time chart illustrating how each feed-water valve is controllably opened and closed according to a sixth embodiment.

FIG. 12 illustrates a sixth embodiment. The sixth embodiment is different from the fourth and fifth embodiments in the process, by the control apparatus 131, of opening and closing control of the FB feed-water valve 121 and the main feed-water valve 120 during the water feeding at the beginning of the wash step. That is, in the sixth embodiment, the control apparatus 131 performs the switching control of the main feed-water valve 120 and the FB feed-water valve based on, instead of the temporal control and the water level control, calculation of the volume of water fed into the washing tub 105 using time integration of detected values from a flowmeter 135. In this case, the flow rate of water in the main water feeding is, for example, 10 liters/minute, and the flow rate of water in the FB water feeding is, for example, 5 liters/minute. In a lower stage in FIG. 12, hatched areas indicate the volume of water fed during each interval.

Specifically, when the wash step is started (time t0), first, the FB feed-water valve 121 is opened to perform FB water feeding. The FB feed-water valve 121 is kept open (FB water feeding) until the volume of feed-water reaches Water Volume 1 (for example, five liters), and at that time (time t1), the FB water feeding is switched to the main water feeding. The main water feeding is continuously performed until the volume of feed-water reaches Water Volume 2 (for example, 10 liters), and at time t2, the main water feeding is switched to the FB water feeding again.

Moreover, when a Water Volume 1 (five liters) of FB water feeding is performed, the FB water feeding is switched to the main water feeding (time t3). When a Water Volume 2 (10 liters) of main water feeding is performed, the main water feeding is switched to the FB water feeding (time t4). When a Water Volume 1 (five liters) of FB water feeding is performed, the FB water feeding is switched to the main water feeding (time t5). The third main water feeding is continuously performed until a Water Volume 2 of main water feeding is repeated three times (for example, 30 liters). When the main water feeding is ended (time t6), the main feed-water valve 120 is closed and the wash step is started.

According to the sixth embodiment as described above, as is the case with the fourth embodiment, the UFB unit 128 for generating fine bubbles is provided to allow the main water feeding and the FB water feeding to be alternated with each other during the initial phase of water feeding. This allows the effective use of fine bubbles to improve the washing performance based on the interaction between the detergent and the fine bubbles. Furthermore, particularly in the present embodiment, the main feed-water valve 120 and the FB feed-water valve 121 are switched based on the volume of feed-water measured by the flowmeter 135. Thus, the general water feeding can be achieved by reliably switching from the FB water feeding to the main water feeding while obtaining a needed volume of fine bubble water through the FB water feeding, with no adverse effects of a low water pressure or the like.

Seventh Embodiment

Figure 13:
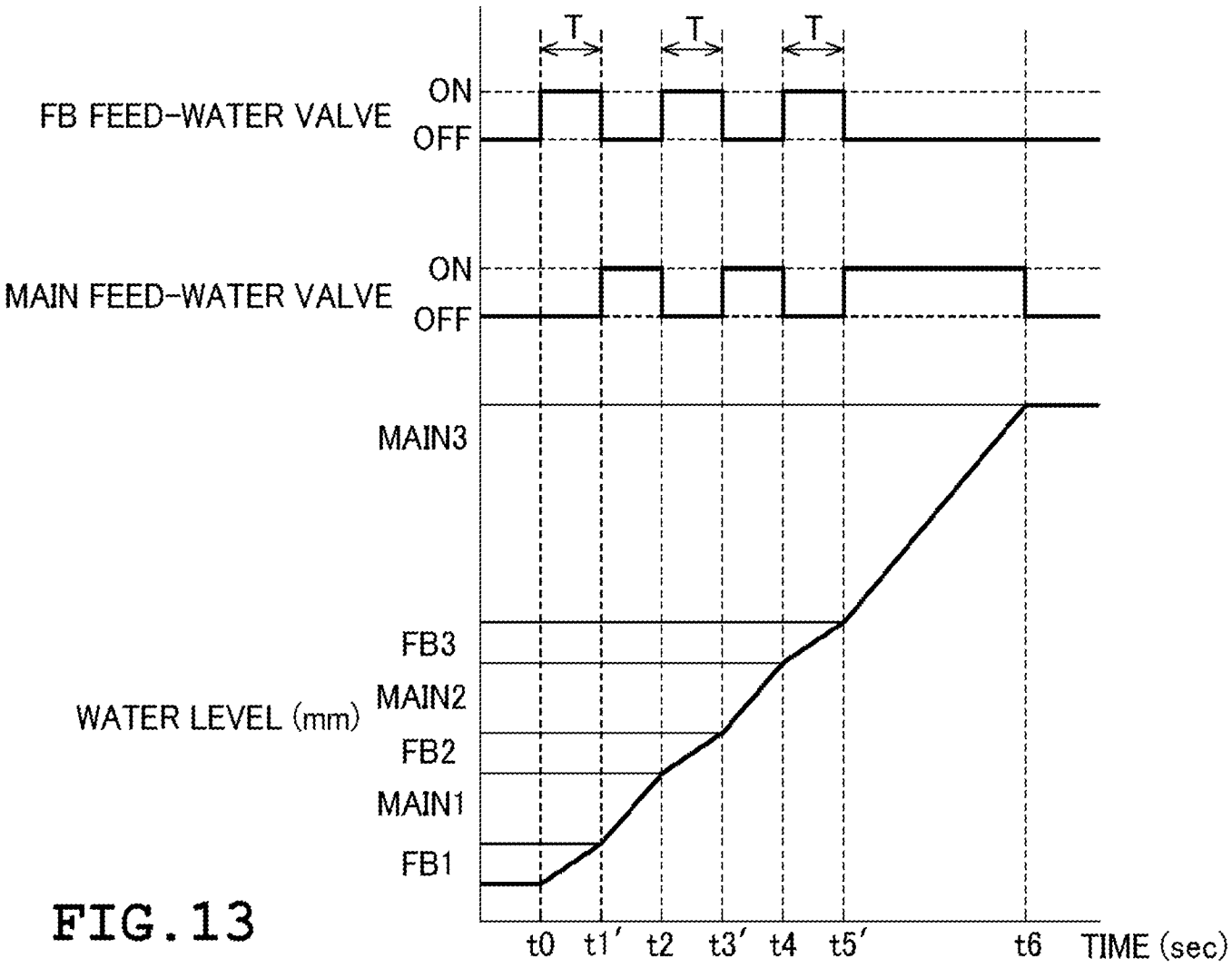
FIG. 13 is a time chart illustrating how each feed-water valve is controllably opened and closed according to a seventh embodiment.

FIG. 13 illustrates a seventh embodiment that is different from the fourth embodiment in the process, by the control apparatus 131, of opening and closing control of the FB feed-water valve 121 and the main feed-water valve 120 during the water feeding at the beginning of the wash step. That is, in the seventh embodiment, the control apparatus 131 performs the switching control of the main feed-water valve 120 and the FB feed-water valve based on the time count and the detection of the water level in the washing tub 105 by the water level sensor 133. In this case, as is the case with the fifth embodiment, the control based on the water level detection is basically performed, and the temporal control is further performed.

Specifically, when the wash step is started (time t0), first, the FB feed-water valve 121 is opened to perform the FB water feeding until the water level reaches FB1 (for example, equivalent to five liters). However, even if the water level has not reached FB1, elapse of a predetermined time T (for example, one minute) forces the FB water feeding to be switched to the main water feeding (time t1'). The main water feeding is continuously performed until the water level reaches Main 1 (for example, equivalent to 15 liters), and at time t2, the main water feeding is switched to the FB water feeding again.

The second FB water feeding is continuously performed until the water level reaches FB2 (for example, equivalent to 20 liters). However, again, even if the water level has not reached FB2, elapse of the predetermined time T (for example, one minute) forces the FB water feeding to be switched to the main water feeding (time t3'). The second main water feeding is continuously performed until the water level reaches Main 2 (for example, equivalent to 30 liters), and at time t4, the main water feeding is switched to the FB water feeding.

The third FB water feeding is continuously performed until the water level reaches FB3 (for example, equivalent to 30 liters). However, again, even if the water level has not reached FB3, elapse of the predetermined time T (for example, one minute) forces the FB water feeding to be switched to the main water feeding (time t5'). The third main water feeding is continuously performed until the water level reaches Main 3 with a predetermined water level (for example, equivalent to 65 liters) is reached. When the water feeding up to the predetermined water level in the water tub 104 is ended (time t6), the main feed-water valve 120 is closed and the wash stem is started.

According to the seventh embodiment as described above, as is the case with the fourth embodiment, the UFB unit 128 for generating fine bubbles is provided to allow the main water feeding and the FB water feeding to be alternated with each other during the initial phase of water feeding. This allows the effective use of fine bubbles to improve the washing performance based on the interaction between the detergent and the fine bubbles. Particularly in the present embodiment, the main feed-water valve 120 and the FB feed-water valve 121 are, for example, basically controlled based on the detection of the water level in the washing tub 105, and the temporal control is further performed. Consequently, possible defects such as an unnecessarily long time of FB water feeding are prevented to allow washing to be finished within a scheduled time.

Eighth Embodiment

Figure 14:
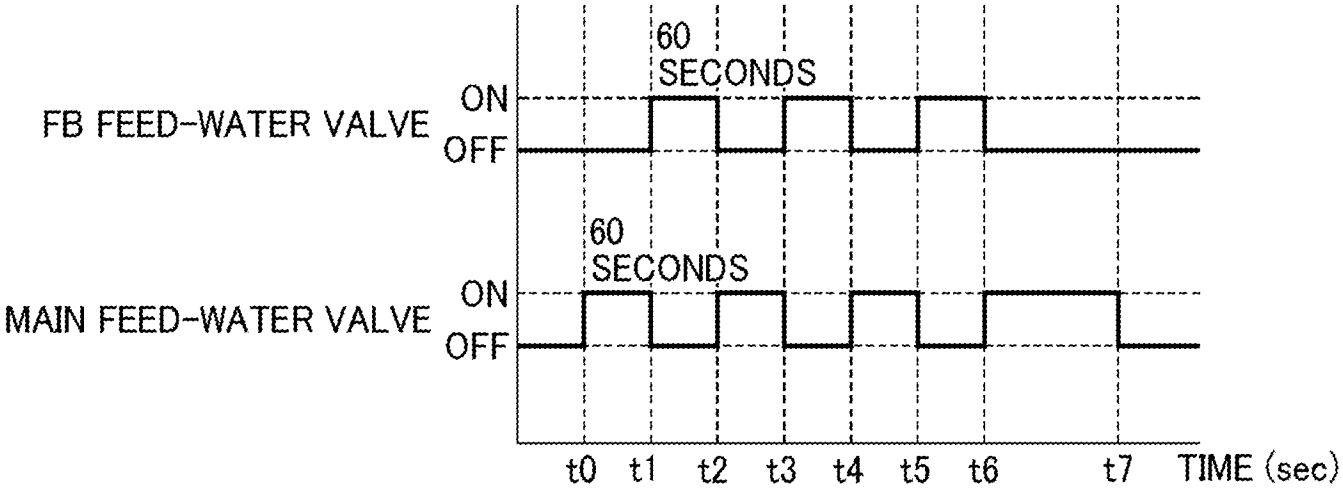
FIG. 14 is a time chart illustrating how each feed-water valve is controllably opened and closed according to an eighth embodiment.

FIG. 14 illustrates an eighth embodiment that is different from the fourth embodiment in the process, by the control apparatus 131, of opening and closing control of the FB feed-water valve 121 and the main feed-water valve 120 during the water feeding at the beginning of the wash step. That is, in the present embodiment, the control apparatus 131 is configured to first open the main feed-water valve 120 at the beginning of water feeding.

Specifically, when the wash step is started (time t0), first, the main feed-water valve 120 is opened to perform the main water feeding for, e.g., 60 seconds. At time t1, the main feed-water valve 120 is closed and the FB feed-water valve 121 is opened. Thus, the main water feeding is switched to the FB water feeding, which is performed for, e.g., 60 seconds. At time t2, the FB water feeding is switched to the main water feeding again.

As described above, the switching between the main water feeding and the FB water feeding is alternately performed, for example, every 60 seconds. When, for example, the third FB water feeding is ended (time t6), the FB water feeding is switched to the main water feeding again (fourth time). For example, the fourth main water feeding is continuously performed until the water level in the water tub 104 (washing tub 105) reaches a predetermined water level. When the water feeding up to the predetermined water level in the water tub 104 is performed (time t7), the main feed-water valve 120 is closed and the wash step is started.

According to the eighth embodiment as described above, the UFB unit 128 for generating fine bubbles is provided to allow the main water feeding and the FB water feeding to be alternated with each other during the initial phase of water feeding. This allows the effective use of fine bubbles to improve the washing performance based on the interaction between the detergent and the fine bubbles. In the present embodiment, the main water feeding is first performed. consequently, even if the detergent housed in the detergent housing unit 123 is a detergent relatively difficult to dissolve such as washing powder, the main water feeding allows the detergent to be reliably fed into the washing tub 105 in the form of a washing solution with no detergent remaining in the detergent housing unit. Therefore, with a large volume of washing solution on the surface of the water in the washing tub 105 or on the surfaces of the clothes, mixture of the washing solution with the fine bubble water allows the fine bubbles to be effectively used.

Ninth Embodiment and Other Embodiments

Figure 15:
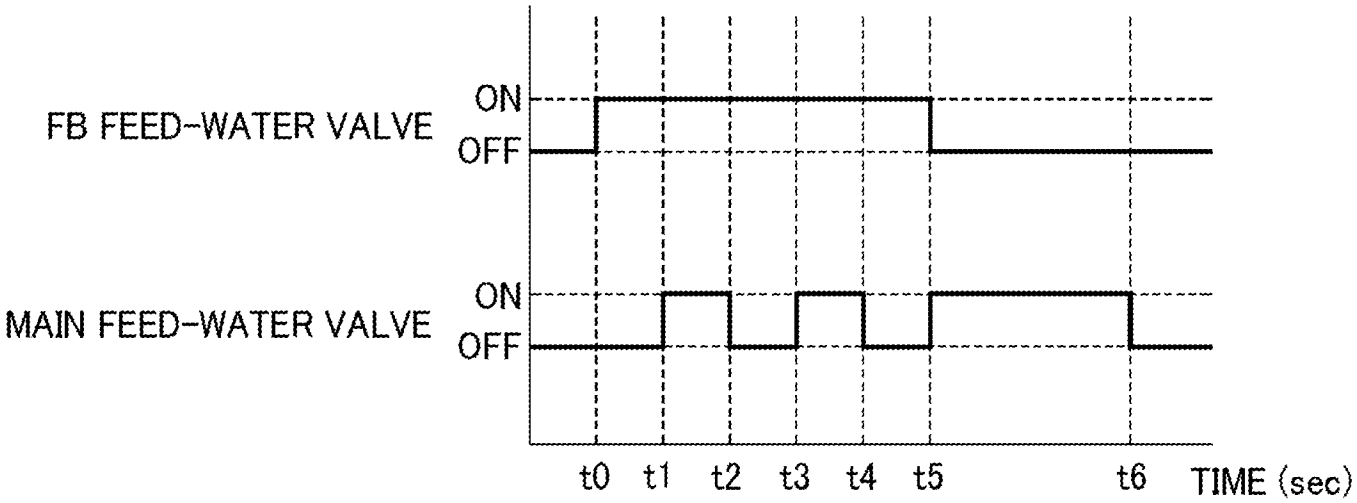
FIG. 15 is a time chart illustrating how each feed-water valve is controllably opened and closed according to a ninth embodiment.

FIG. 15 illustrates a ninth embodiment different from the fourth embodiment in that, when starting water feeding, the control apparatus 131 first opens the FB feed-water valve 121 and subsequently simultaneously opens both the main feed-water valve 120 and the FB feed-water valve 121. That is, when the wash step is started (time t0), first, the FB feed-water valve 121 is opened to perform the FB water feeding for, e.g., 60 seconds. Then, at time t1, with the FB feed-water valve 121 kept open, the main feed-water valve 120 is opened.

Thus, water is fed both through the main feed-water pathway 115 and through the FB feed-water pathway 116 into the water injection case 118 (detergent housing unit 123), and then fed into the washing tub 105. At this time, water from the feed-water source mostly passes through the main feed-water pathway 115, which offers lower resistance, resulting in a reduced flow rate of water in the FB feed-water pathway 116. Thus, substantially no fine bubbles are generated even though the water passes through the UFB unit 128. During this interval (time t1 to time t2), the main water feeding is substantially performed as is the case where the FB feed-water valve 121 is turned off. The main feed-water valve 120 is kept open for, e.g., 60 seconds, and at time t2, the main feed-water valve 120 is turned off to switch to the FB water feeding with only the FB feed-water valve 121 open.

The second FB water feeding is also performed for, e.g., 60 seconds, and at time t3, again, with the FB feed-water valve 121 kept open, the main feed-water valve 120 is opened. The second opening of the main feed-water valve 120 is also performed for, e.g., 60 seconds, and at time t4, the main feed-water valve 120 is turned off to switch to the FB water feeding with only the FB feed-water valve 121 open. For example, when 60 seconds elapse to end the third FB water feeding (time t5), the FB feed-water valve 121 is closed and the main feed-water valve 120 is opened to perform the main water feeding. The main water feeding is continuously performed until the water level in the water tub 104 (washing tub 105) reaches a predetermined water level. At time t6, the main feed-water valve 120 is closed and the wash step is started.

Consequently, first, the fine bubble water is brought into contact with the detergent, and resultant washing water containing the fine bubble water with the detergent dissolved therein is fed to the washing tub 105. Subsequently, both the main feed-water valve 120 and the FB feed-water valve 121 are simultaneously opened. Thus, a large volume of water is flowed to prevent the detergent in the detergent housing unit 123 from remaining undissolved. Therefore, also in the ninth embodiment, the UFB unit 128 for generating fine bubbles is provided to allow the effective use of fine bubbles to improve the washing performance based on the interaction between the detergent and the fine bubbles.

Particularly in the present embodiment, both the main feed-water valve 120 and the FB feed-water valve 121 are simultaneously open during a certain interval. Consequently, with substantially the same water feeding as the main water feeding performed, the number of turning-on and -off operations for the FB feed-water valve 121 can be reduced, allowing improvement of durability (extension of life) of the FB feed-water valve 121.

The present invention is not limited to the above-described embodiments. Although not illustrated in the drawings, for example, the following expansions and variations may be applied. In the above-described embodiments, fine bubble water is used for the wash step, and water not passed through the UFB unit 128 is used for the rinse step. However, for example, water containing a mixture of fine bubble water and common water may be used. Furthermore, specific numerical values such as for the time and the water level (water volume) which are used for the above-described embodiments are only illustrative and may be changed as appropriate. Moreover, in the above-described embodiments, the present invention is applied to the vertical-axis washing machine. However, the present invention is not limited to the vertical-axis washing machine but may be applied to washing machines in general such as a drum washing machine. Additionally, many variations may be made to the configurations of the water injection case (detergent housing unit), the water feeding mechanism, and the like.

Embodiments of the present invention have been described. However, the embodiments are presented as examples and not intended to limit the scope of the invention. These novel embodiments may be implemented in other various forms, and various omissions, replacements, and changes may be made to the embodiments without departing from the spirits of the invention. The embodiments and variations thereof are included in the scope and spirits of the invention and also included in the scope of the inventions recited in the claims and equivalents thereof.

The invention claimed is:

1. A washing machine, comprising:

a water tub storing water;

a rotary tub arranged in the water tub;

a dissolving area in which a detergent or a softener is fed and dissolved;

an FB feed-water pathway which includes a fine-bubble generation apparatus allowing generation of tine bubble water and along which water fed from a feed-water source is passed through the fine-bubble generation apparatus to be fed to the dissolving area as fine bubble water;

an FB feed-water valve opening and closing the FB feed-water pathway; and a control apparatus controlling opening and closing of the FB feed-water valve, wherein the fine-bubble generator is configured to generate fine bubbles including bubbles having a sphere equivalent bubble diameter of 50 nm to 1 μm, and the control apparatus controllably brings the detergent or the softener and the fine bubble water into contact with each other to dissolve the detergent or the softener, in a washing course in which the washing machine is operated and during a period when the detergent or the softener is dissolved in feed-water.

2. The washing machine according to claim 1, wherein the fine-bubble generation apparatus is provided in a middle of the FB feed-water pathway and between the FB teed-water valve and the dissolving area.

3. The washing machine according to claim 1, wherein the ine bubble water mainly comprises nanobubbles.

4. The washing machine according to claim 1, further comprising:

a main feed-water pathway through which water fed from the feed-water source is fed to the dissolving area; and a main feed-water valve opening and closing the main feed-water pathway, the main feed-water pathway being a feed-water pathway not passing through the fine-bubble generation apparatus, wherein the control apparatus controllably opens and closes the FB feed-water valve and the main feed-water valve.

5. A washing machine comprising:

a water tub storing water;

a rotary tub arranged in the water tub;

a dissolving area in which a detergent is fed and dissolved;

an FB feed-water pathway which comprises a fine-bubble generation apparatus allowing generation of fine bubble water and along which water fed from a feed-water source is passed through the fine-bubble generation apparatus to be fed to the dissolving area as fine bubble water;

an FB feed-water valve opening and closing the FB feed-water pathway;

a main feed-water pathway which does not pass through the fine-bubble generation apparatus and through which water fed from the feed-water source is fed to the dissolving area;

a main feed-water valve opening and closing the main teed-water pathway; and a control apparatus controlling opening and closing of the FB feed-water valve and the main feed-water valve.

wherein the water stored in the water tub is mixed water of the fine bubble water and water passed through the feed-water pathway not passing through the fine-bubble generation apparatus.

6. The washing machine according to claim 1, wherein the dissolving area is a detergent case to which a feed-water pathway passing through the fine-bubble generation apparatus is connected, the detergent case having a feed-water inlet through which water is fed to the water tub.

7. The washing machine according to claim 5, wherein a pulsator stirring laundry is provided at a bottom portion of the rotary tub, and the dissolving area is positioned below the pulsator.

8. The washing machine according to claim 5, wherein the dissolving area. is a bottom of the water tub, the fine bubble water is injected into an area between the water tub and the rotary tub, and the fine bubble water comes into contact with the detergent which is fed into the dissolving area beforehand, before coming into contact with laundry in the rotary tub.

9. A washing machine comprising:

a washing tub in which clothes are housed;

a water injection case which has a detergent housing unit and through which water is fed to the washing tub;

an FB feed-water pathway which comprises a fine-bubble generation apparatus and along which water fed from a feed-water source is passed through the fine-bubble generation apparatus to be fed to the water injection case as fine bubble water;

an FB feed-water valve opening and closing the FB feed-water pathway;

a main feed-water pathway configured to have a higher flow rate than the FB feed-water pathway and which does not pass through the fine-bubble generation apparatus, the main feed-water pathway allowing water fed from the feed-water source to be fed to the water injection case;

a main feed-water valve opening and closing the main feed-water pathway; and a control apparatus controlling the main feed-water valve and the FB feed-water valve, wherein the detergent housing unit is a dissolving area for a detergent, and the control apparatus feeds water by alternately opening the main feed-water valve and the FB feed-water valve during an initial phase of water feeding.

10. The washing machine according to claim 9, wherein the control apparatus performs switching control of the main feed-water valve and the FB feed-water valve based on counting of an open time.

11. The washing machine according to claim 9, wherein the control apparatus performs switching control of the main feed-water valve and the FB feed-water valve based on detection of a water level in the washing tub.

12. A washing machine, comprising:

a water tub storing water;

a rotary tub arranged in the water tub;

a dissolving area in which a detergent is fed and dissolved;

an FB feed-water pathway which includes a fine-bubble generation apparatus allowing generation of fine bubble water and along which water fed from a feed-water source is passed through the fine-bubble generation apparatus to be fed to the dissolving area as fine bubble water;

an FB feed-water valve opening and closing the FB feed-water pathway; and a control apparatus controlling opening and closing of the FB feed-water valve, wherein the control apparatus controllably brings the detergent and the fine bubble water into contact with each other to dissolve the detergent, in a washing course in which the washing machine is operated and during a period when the detergent is dissolved in feedwater, and the dissolving area is a detergent case to which a feed-water pathway passing through the fine-bubble generation apparatus is connected, the detergent case having a feed-water inlet through which water is fed to the water tub.

13. A washing machine, comprising:

a water tub storing water;

a rotary tub arranged in the water tub;

a dissolving area in which a detergent is fed and dissolved;

an FB feed-water pathway which includes a fine-bubble generation apparatus allowing generation of fine bubble water and along which water fed from a feed-water source is passed through the fine-bubble generation apparatus to be fed to the dissolving area as fine bubble water;

an FB feed-water valve opening and closing the FB feed-water pathway;

a main feed-water pathway through which water fed from the feed-water source is fed to the dissolving area;

a main feed-water valve opening and closing the main feed-water pathway, the main feed-water pathway being a feed-water pathway not passing through the fine-bubble generation apparatus; and a control apparatus controlling opening and closing of the FB feed-water valve and the main feed-water valve, wherein the control apparatus controllably brings the detergent and the fine bubble water into contact with each other to dissolve the detergent, in a washing course in which the washing machine is operated and during a period when the detergent is dissolved in feedwater.

14. The washing machine according to claim 13, wherein, when water feeding is started, the control apparatus first opens the FB feed-water valve and subsequently simultaneously opens both the main feed-water valve and the FB feed-water valve.

15. The washing machine according to claim 13, wherein both the fine bubble water and the water passed through the feed-water pathway not passing through the fine-bubble generation apparatus are fed to the dissolving area.

16. The washing machine according to claim 13 wherein the control apparatus controllably starts passing water through the feedwater pathway passing through the fine-bubble generation apparatus and then passes water through the feed-water pathway not passing through the fine-bubble generation apparatus.

* * * * *